US005653185A

United States Patent [19]

Badillo

[11] Patent Number: 5,653,185

[45] Date of Patent: Aug. 5, 1997

[54] JUMP FOOT KIT ASSEMBLY

[75] Inventor: Paul Badillo, Littleton, Colo.

[73] Assignee: Ralph's Industrial Sewing Machine Company, Denver, Colo.

[21] Appl. No.: 501,286

[22] Filed: Jul. 12, 1995

[51] Int. Cl.[6] ..... D05B 29/12; D05B 75/00

[52] U.S. Cl. ..... 112/240; 112/168; 112/259

[58] Field of Search ..... 112/235, 240, 112/168, 259

[56] References Cited

U.S. PATENT DOCUMENTS

| | | | |
|---|---|---|---|
| 349,438 | 9/1886 | Looker | 112/259 |
| 361,427 | 4/1887 | Looker | 112/259 |
| 4,421,042 | 12/1983 | Killinger | 112/259 |
| 4,590,875 | 5/1986 | Sanvito et al. | 112/168 |
| 4,996,934 | 3/1991 | Lue | 112/259 X |
| 5,158,026 | 10/1992 | Badillo et al. . | |
| 5,441,003 | 8/1995 | Hashiride | 112/168 X |

*Primary Examiner*—Paul C. Lewis
*Attorney, Agent, or Firm*—Sheridan Ross P.C.

[57] ABSTRACT

A jump foot kit assembly for a sewing machine. As such, the invention is particularly useful in providing jump foot capabilities to sewing machines which were not configured by the manufacturer to have jump foot capabilities. In one embodiment, the jump foot kit assembly includes a housing which is detachably interconnectable with the sewing machine. The housing includes a bore extending through at least a lower portion of the housing such that a jump foot bar may be movably received therein. A jump foot is preferably detachably connected to a lower portion of the jump foot bar and an appropriate linkage assembly may operatively interconnect the sewing needle drive assembly and the jump foot bar to move the jump foot into and out of engagement with stitchable material being sewn upon by the sewing needle in timed relation with the sewing needle.

21 Claims, 27 Drawing Sheets

JUMP FOOT KIT ASSEMBLY

FIELD OF THE INVENTION

The present invention generally relates to sewing machines and more particularly, to a jump foot assembly in the form of a kit for retaining the stitchable material during movement of the sewing needle to reduce the potential for flagging.

BACKGROUND OF THE INVENTION

Generally, sewing machines typically include a head which contains much of the sewing needle drive assembly and a base which includes a throat plate having a needle hole therethrough such that the needle may interact with other sewing components contained within the base. Many sewing machines also include a jump foot which is contained within the casting of the sewing machine and which engages/disengages the material being sewn on by the machine ("stitchable material") in a timed relation with the movement of the sewing needle. The jump foot functions as an "anti-flagging" device. Flagging is a condition which occurs when stitchable material and thread are pulled upwardly with the sewing needle after a portion of the sewing needle and thread have been driven down through the stitchable material and are thereafter being driven upwardly. Due to the frictional engagement between the sewing needle, thread, and stitchable material, the portion of thread adjacent a side of the sewing needle and below the stitchable material cannot sufficiently separate from the side of the sewing needle to form a loop through which an oscillating sewing shuttle hook can pick up the thread to form a stitch. As such, flagging can result in a poor stitching pattern and including having a sewing pattern with skips. Thus, in sewing machines having a jump foot, the jump foot functions to hold the stitchable material and a portion of the thread stationary relative to the upwardly moving sewing needle to separate the portion of thread from a side of the sewing needle to form a loop through which a sewing shuttle hook can pass to form the desired stitch.

Although many sewing machines do come with a jump foot assembly contained within the casting of the machine, a number of sewing machines do not have a jump foot. Some of these machines utilize a presser foot or the like which, during reciprocation by the sewing needle, always remain in contact with the stitchable material. That is, the presser foot does not move in a timed relation with the sewing needle. These machines will typically have a feed dog disposed under the stitchable material and the displaced feet of the presser foot to linearly advance the stitchable material.

One type of kit of sorts which has been utilized in the sewing industry to reduce problems with flagging is a needle plunger. A needle plunger is effectively a hollow tube which is concentrically mounted on the lower end of a needle bar such that the sewing needle extends and protrudes below the lower end of the spring-loaded plunger. As the needle bar is driven downwardly to make a stitch in the stitchable material, the spring-loaded plunger traps the stitchable material between the plunger and the throat plate, thus holding the stitchable material stationary relative to the reciprocating sewing needle. The plunger remains engaged with the stitchable material as the sewing needle is driven upwardly a sufficient amount of time to reduce the potential for flagging of the stitchable material. Although the needle plunger functions appropriately in many applications, as production speeds are increased, noise can become a problem, and mechanical difficulties may arise as well.

SUMMARY OF THE INVENTION

The present invention generally relates to a jump kit assembly which is detachably connectable to a sewing machine so as to provide jump foot capabilities, primarily for those sewing machines which do not have jump foot capabilities as originally manufactured and distributed. The jump foot kit assembly may thus be installed on the sewing machine and used for certain sewing operations, but may thereafter be removed entirely from the machine if desired/required for different types of sewing operations.

A typical sewing machine which may benefit from principles of the present invention includes a head which contains many of the drive components for the sewing machine within its casting, a sewing needle which reciprocates relative to the head via movement of the sewing needle drive assembly contained within the head, and a base which provides a support for the machine and which includes a throat plate having a hole through which the sewing needle passes to interact with other sewing components disposed below the throat plate to form the desired stitch.

The jump foot kit assembly of the present invention includes a housing which is detachably connectable to the sewing machine, typically to the head. That is, the housing is separable from the sewing machine, including the casting of the sewing machine head which contains the various sewing needle drive componentry. This housing has a bore extending through at least a lower portion thereof which is adapted to receive a jump foot driver or bar which transmits the desired motion to the jump foot attachable to the jump foot driver/bar. Typically, the desired movement is in timed relation relative to the movement of the sewing needle such that the potential for flagging of the material being sewn (i.e., "stitchable material") will be reduced. Preferably, the jump foot retains the stitchable material against the throat plate a sufficient amount of time during retraction of the sewing needle to provide the desired reduction in flagging.

The preferred timed movement of the jump foot kit assembly in relation to the sewing needle may be achieved by operatively interfacing the jump foot kit assembly with the sewing needle drive assembly. In the case of a cam driven sewing machine, the sewing needle drive assembly includes a generally vertical reciprocating needle bar to which the sewing needle is attached. The jump foot kit assembly may therefore further include a linkage system for moving the jump foot bar/driver as the sewing needle assembly is driven by interconnecting the jump foot bar/driver with the needle bar. This linkage system may include a cam which interfaces with and is driven by the needle bar of the sewing needle assembly, a first link which is pivotally connected to the housing and which has a roller rotatably mounted thereon for engaging the cam, and a second link which interconnects the first link and the jump foot bar/driver. The linkage system is preferably configured such that the sewing needle drive assembly, via the linkage system, drives the jump foot assembly in a time-delayed or lagging fashion, in order to enhance the anti-flagging benefits provided by the present invention.

The jump foot kit assembly may further include an actuator which is operatively interconnected with the jump foot assembly for adjusting the position of the roller of the linkage system relative to the cam. For instance, the actuator may move the jump foot bar/driver from a position in which the roller remains engaged with the cam when activation of the jump foot is desired, and another position to disengage the roller from the cam to deactivate the jump foot bar/driver, to thereby deactivate the jump foot embodiment, this actuator is an air cylinder.

DETAILED DESCRIPTION

A kit assembly 12 is initially described herein. Although the kit assembly 12 may be used with standard sewing machines such as the cam-driven pattern tacker sewing machine 500 discussed below in relation to FIGS. 20–28 (particularly in combination with the material transfer assembly 531), it is also advantageous when used in combination with a programmable sewing machine 16 of the type illustrated in FIG. 1 to provide fully automated buttonhole sewing operations. Moreover, although buttonholes are primarily described herein, it will be appreciated that other types of material removal or cutting operations may be appropriate for use of the kit assembly 12.

Figure 1:
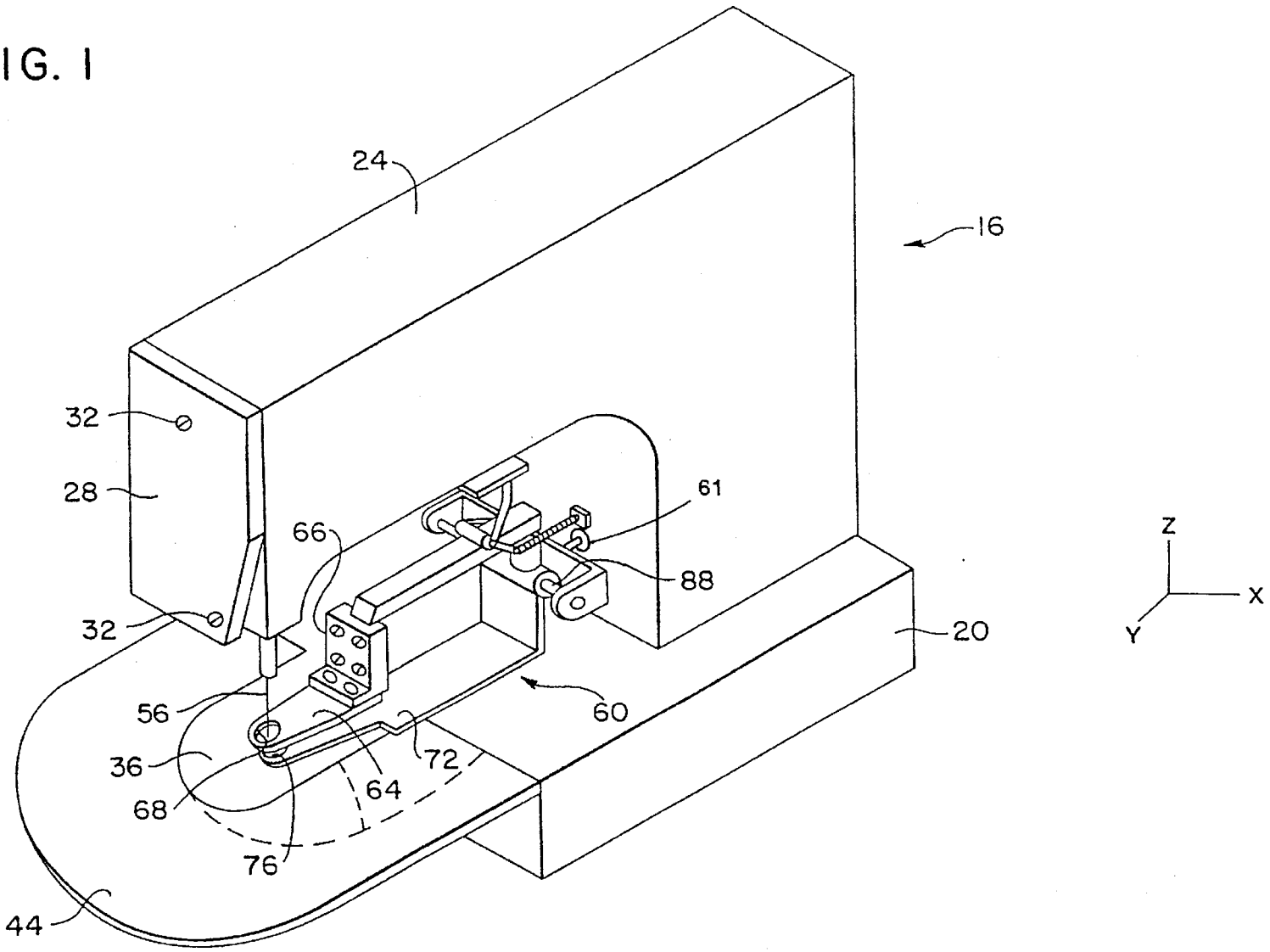
FIG. 1 is a perspective view of a known programmable sewing machine.

With reference primarily to FIG. 1, the programmable sewing machine 16 typically includes a base 20 which functions as a support, a head 24 which contains a portion of the sewing drive assembly 48 (FIG. 3), a detachable head cover 28 for accessing the sewing drive assembly 48 (FIG. 3), a cylinder bed or throat plate 36 which contains sewing components assembly 52 (FIGS. 3, 5, and 7) which interact with the sewing needle 56 to produce the desired stitch and which are positioned below the throat plate (e.g., a sewing area), a detachable support plate 44 which is positioned around the cylinder bed 36 to provide a surface for supporting the material to be stitched (FIG. 1), and a presser foot or arch clamp assembly 60 (FIG. 1) which moves the material to be stitched relative to the sewing needle 56 to produce the desired pattern. In order to produce this movement of the presser foot or arch clamp assembly 60, a programmable computer (not shown) governs control motors (not shown) which in turn direct the movement of the presser foot assembly 60 along and relative to the cylinder rod 88 (FIG. 2), inwardly and outwardly by an another extendable/retractable cylinder rod 61 which is substantially perpendicular to the rod 88 and which is fixedly attached to the support for the rod 88, and vertically via the illustrated linkages. Consequently, various stitching patterns may be stored in computer memory and accessed by the software to produce a preselected design.

Figure 2:
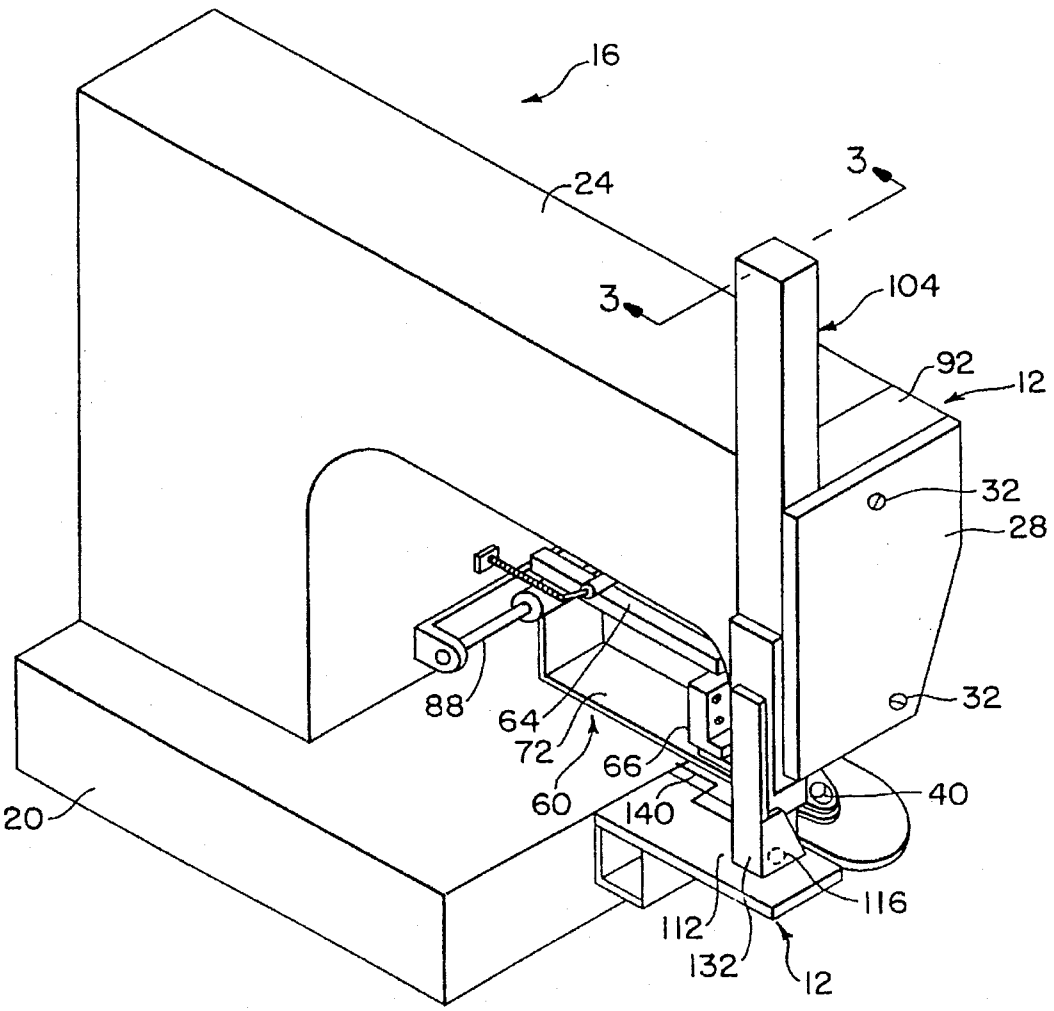
FIG. 2 is a perspective view of the programmable sewing machine of FIG. 1 incorporating a material removal unit to provide a material removal and sewing assembly.

One embodiment of the kit assembly 12 is illustrated in FIG. 2 as it would be typically attached to the programmable sewing machine 16 of FIG. 1, and thus forms a sewing and material removal assembly. The kit assembly 12 generally includes a support assembly 92 which is detachably connected to the end of the head 24 for containing the material removal device 120 (FIGS. 3–4), a driver 104 positioned above the head 24 which is coupled to and drives the material removal device 120, a table 112 which is detachably connected to the programmable sewing machine 16 substantially adjacent to and parallel with the cylinder bed 36, and a guard 132 which is pivotally attached to the support assembly 92 to protect against inadvertent dislodging of the material removal device 120 during sewing operations.

The support assembly 92 is configured to position the material removal device 120 contained therein so as to not interfere with the sewing drive assembly 48 or the sewing components assembly 52, including the sewing needle 56, of the programmable sewing machine 16. In one embodiment illustrated in FIGS. 3–4, a bore 96, positioned within the support assembly 92 and extending substantially vertically therethrough, guides the material removal device 120. This configuration reduces the deflection of the material removal device 120 when used on thicker and/or more resilient stitchable materials 144. In order to provide for a more frictionless engagement between the material removal device 120 and the bore 96, a sleeve bearing 100 of the type well known in the art is positioned therebetween.

The material removal device 120 generally includes a shaft 124, positioned within the bore 96 and coupled with the driver shaft 108 of the driver 104 by methods such as threaded engagement, and a cutting head 128 which removes stitchable material 144 to produce an opening of a desired contour. As can be appreciated, the cutting head 128 may be alternately configured to produce various contours of openings. Furthermore, the cutting head 128 may be a punch, cutting tool or any other suitable device for removing material. Although the shaft 124 and the cutting head 128 of the material removal device 120 may be integrally formed, the cutting head 128 in one embodiment is detachably connected to the shaft 124 by methods such as threaded engagement.

Figure 3:
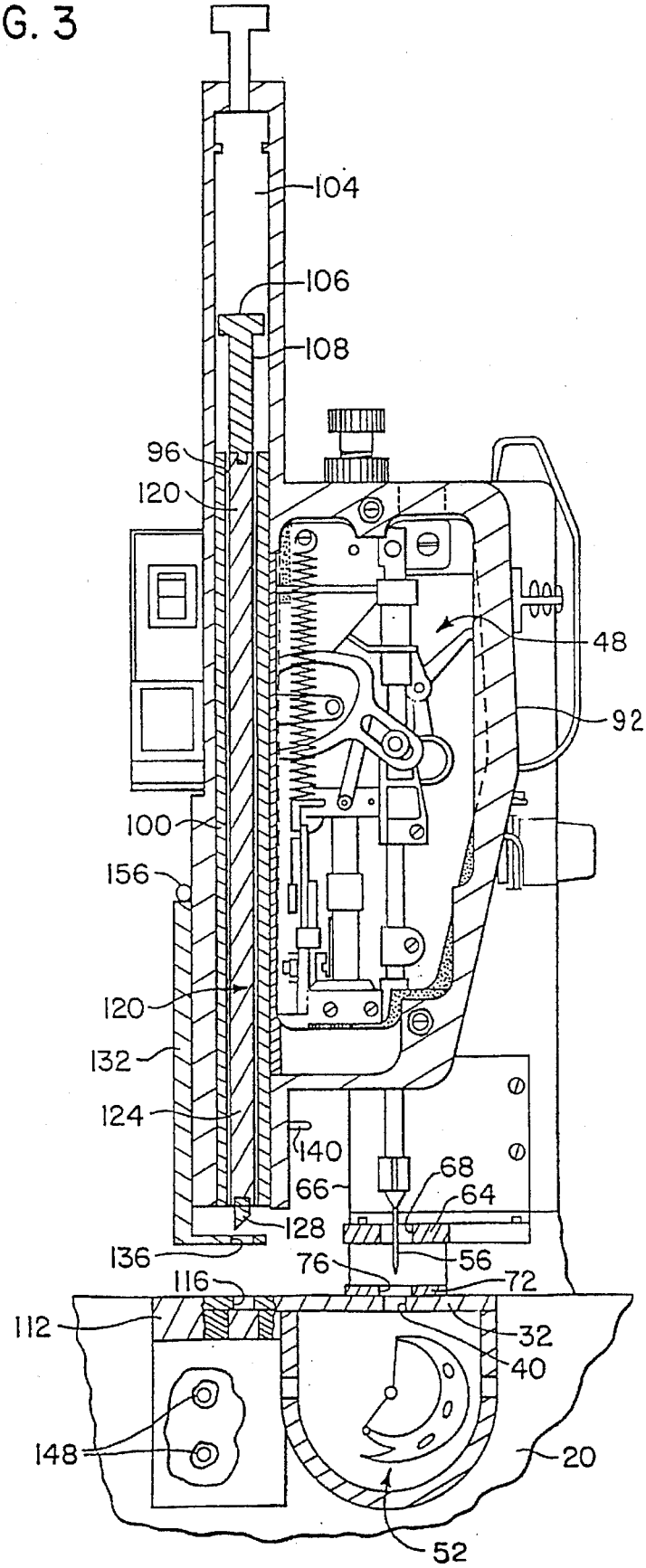
FIG. 3 is a cross-sectional view of the material removal unit of FIG. 2 taken along line 3—3.
Figure 4:
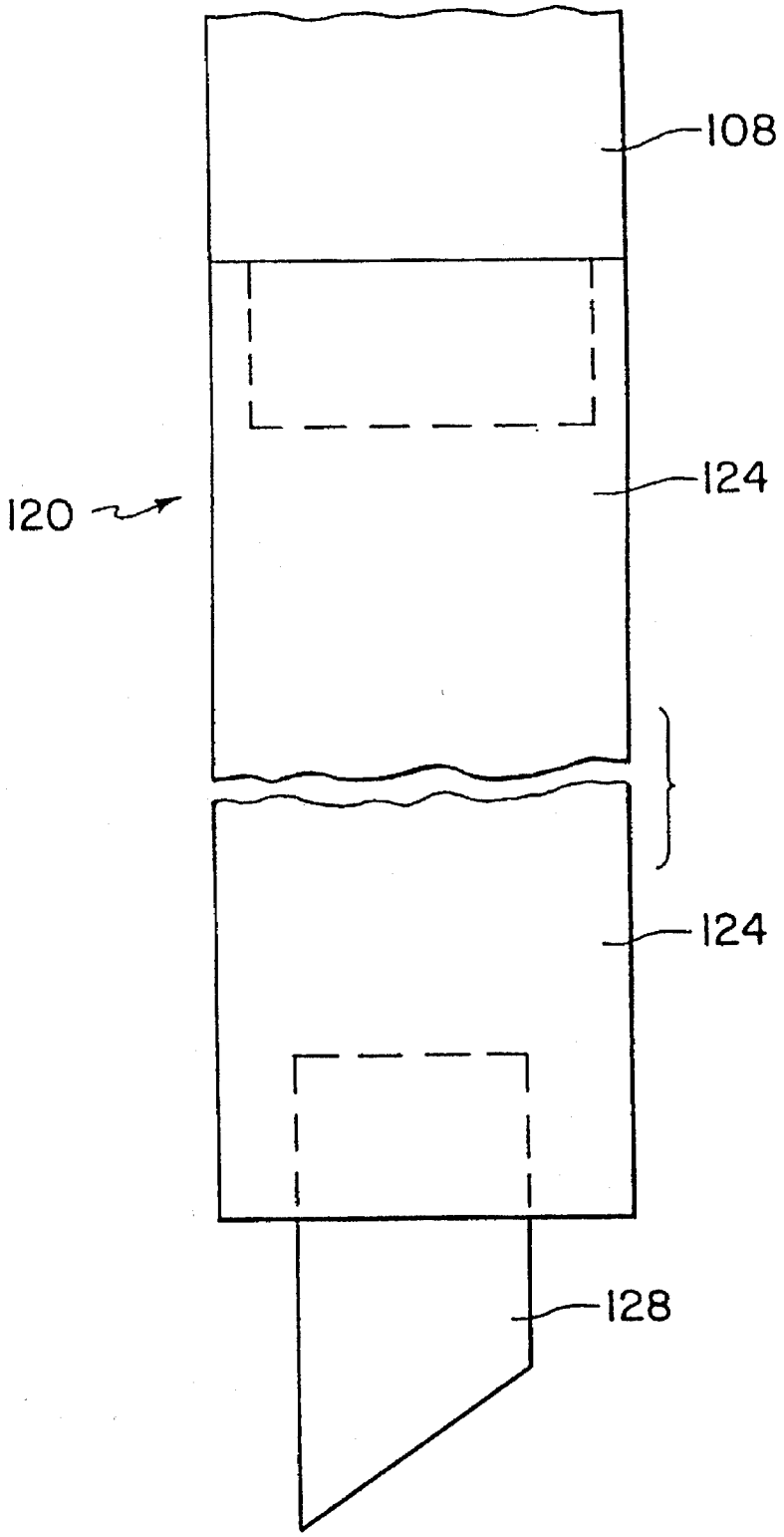
FIG. 4 is an enlarged view of one embodiment of a material removal device and its detachable connections.

The material removal device 120 is coupled with the driver 104 which supplies the necessary driving forces for material removal operations as best illustrated in FIGS. 3–4. Although numerous types of drivers 104 may be used and placed in a variety of positions, in one embodiment the driver is an air cylinder which is positioned above the head 24 and driven by an appropriate source (not shown). This positioning is advantageous in that a larger capacity driver 104, in this case an air cylinder having a driver piston 106 and driver shaft 108, may be used (i.e., more force application capacity) without interfering with the sewing drive assembly 48 or the sewing components assembly 52.

Figure 5:
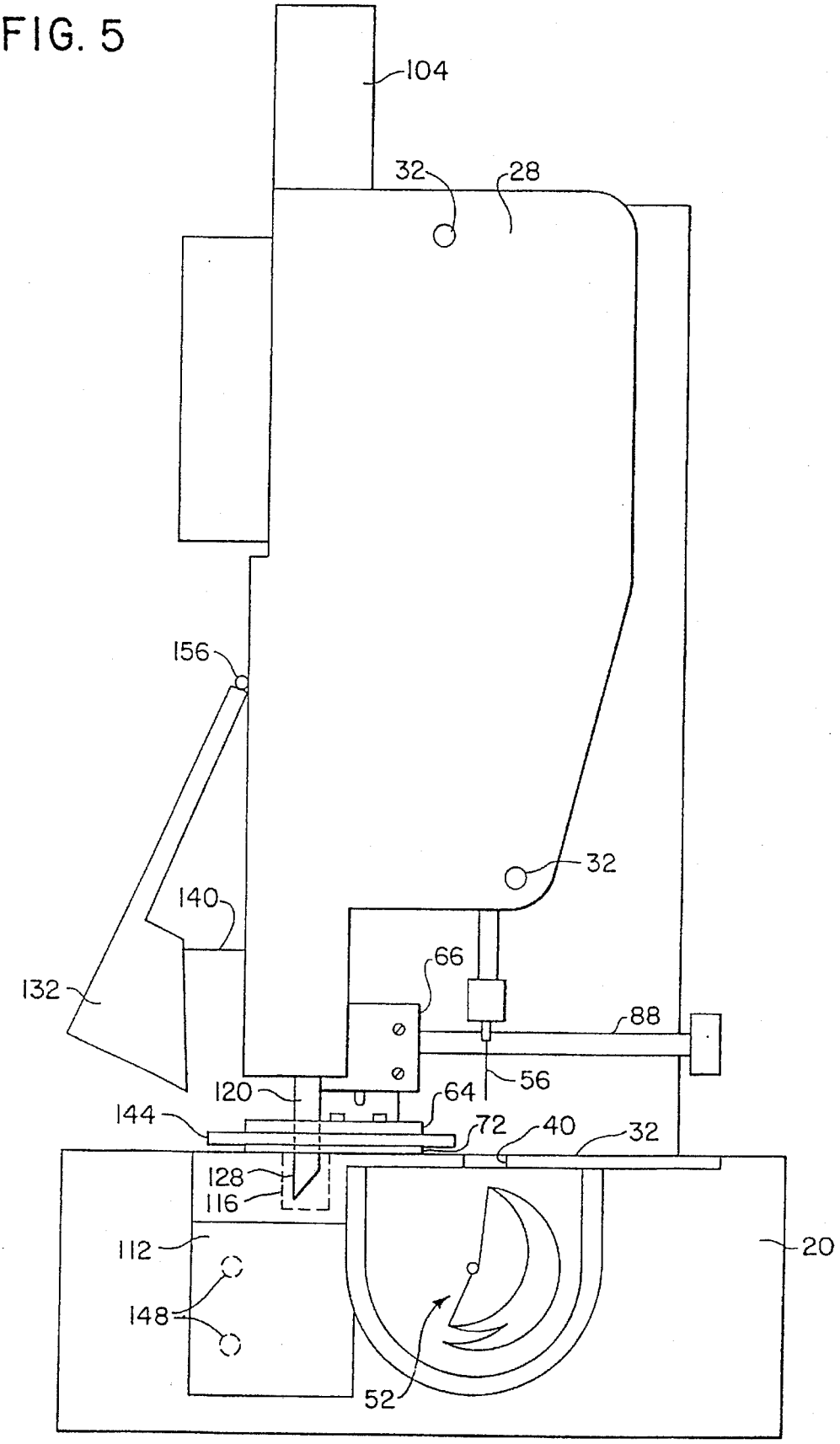
FIG. 5 is a front view of the assembly of FIG. 2, illustrating the positioning of the jump foot assembly and guard during material removal operations.
Figure 6:
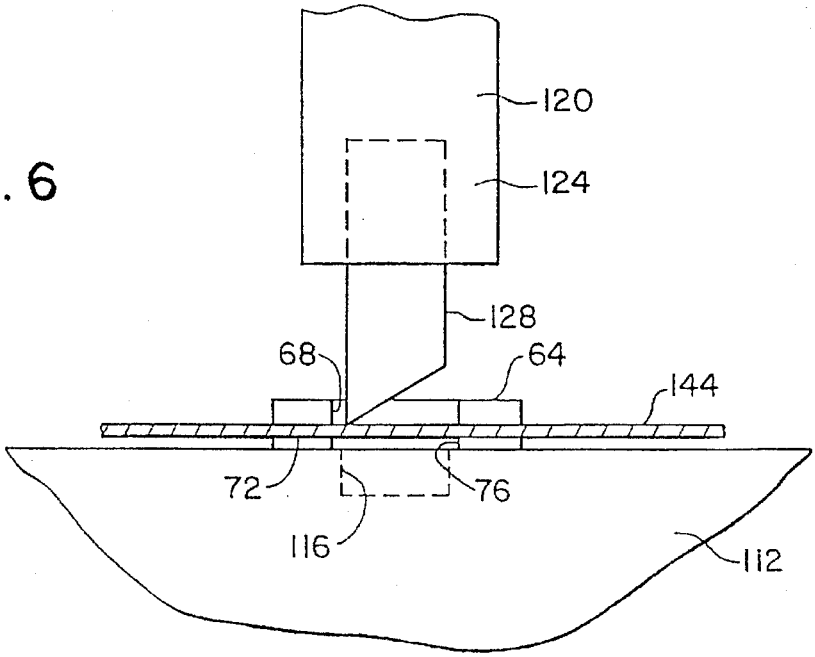
FIG. 6 is an enlarged front view of one embodiment of a material removal device during material removal operations.
Figure 8:
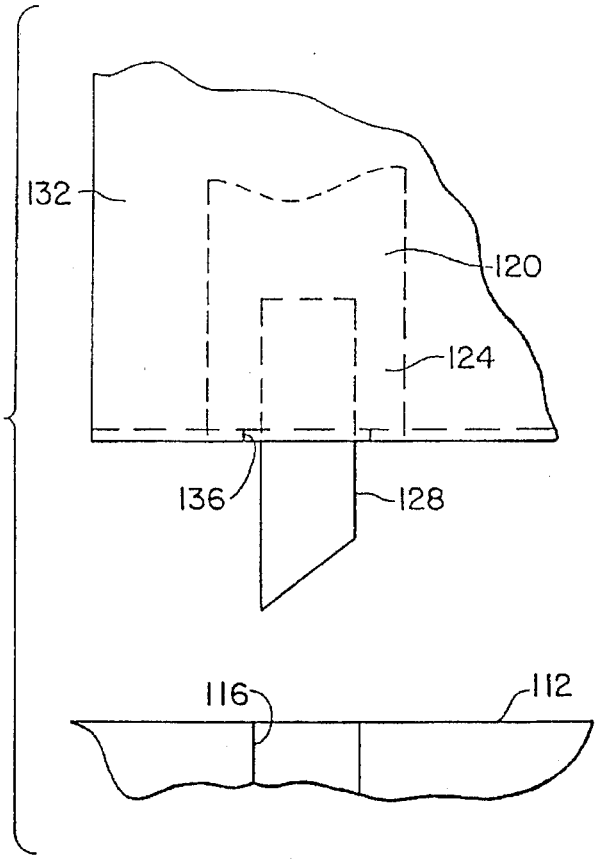
FIG. 8 is an enlarged front view illustrating the restricting of the downward movement of one embodiment of a material removal device by the guard.
Figure 7:
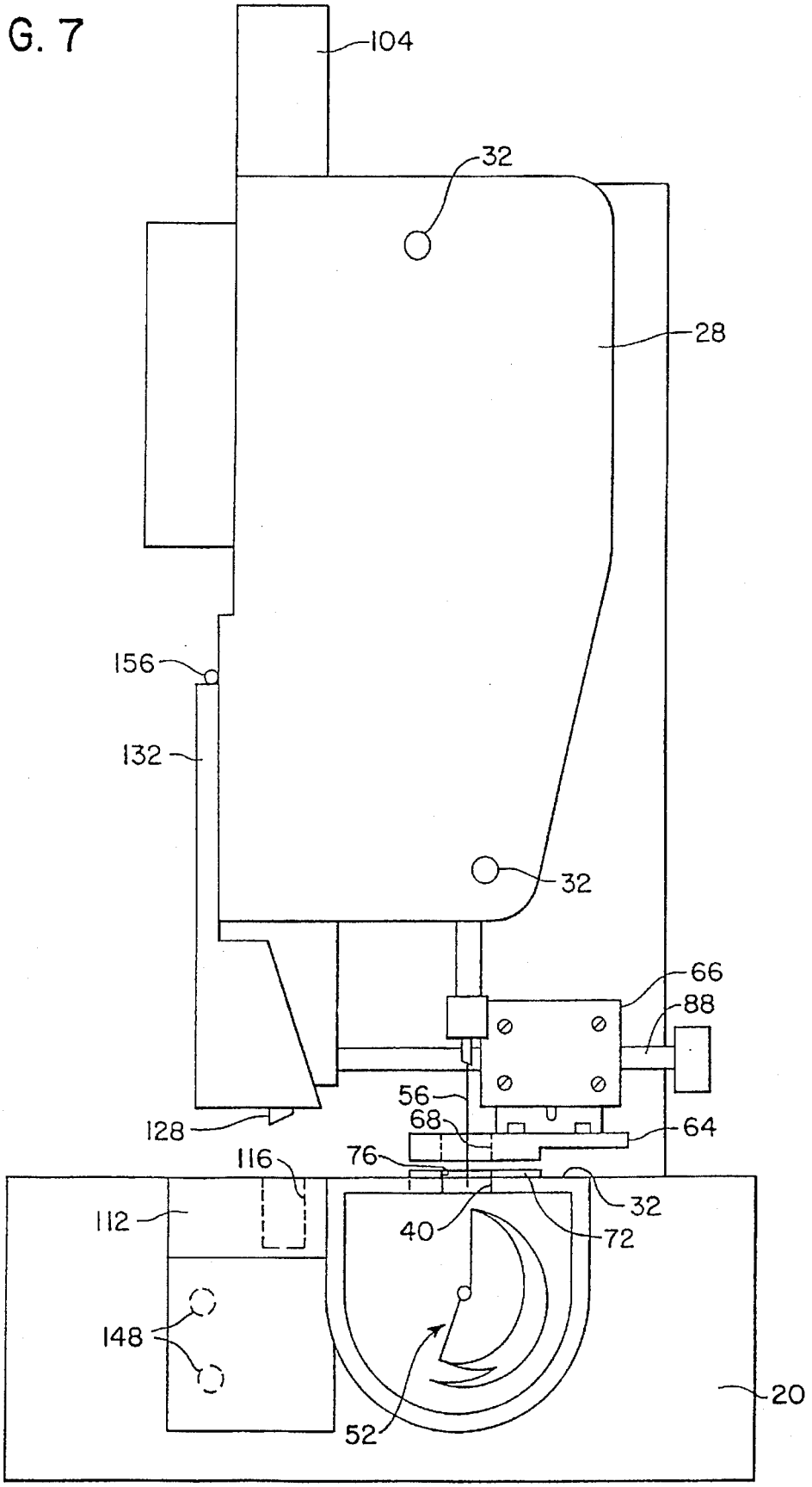
FIG. 7 is a front view of the assembly of FIG. 2, illustrating the positioning of the jump foot assembly and guard during sewing operations.
Figure 10:
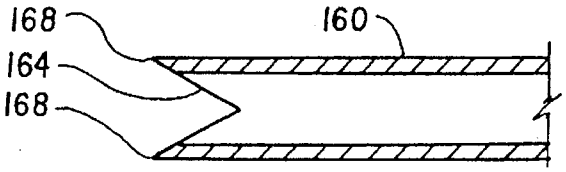
FIG. 10 is a cross-sectional view of the material removal device of FIG. 9 taken along line 10—10.
Figure 9:
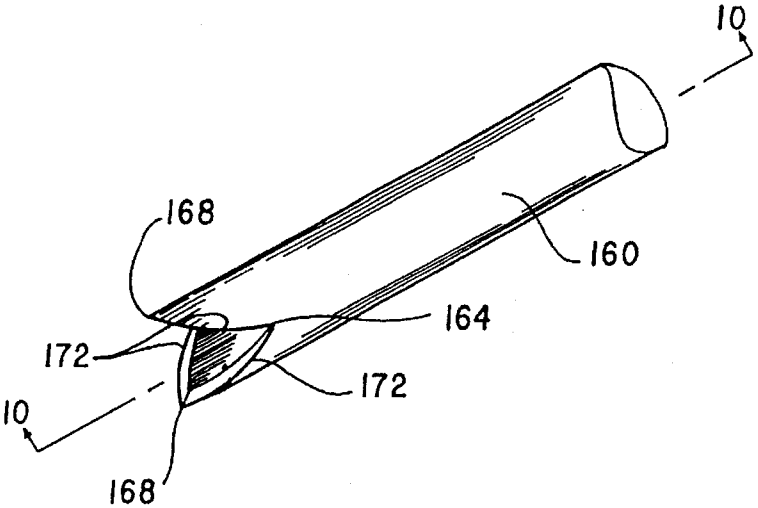
FIG. 9 is a perspective view of one embodiment of a hollow material removal device.

For purposes of enhancing operator safety during buttonhole sewing operations, a shelter or guard 132 is suitably attached to the support assembly 92, typically by a pivotal connection 156, as illustrated in FIGS. 3, 5, and 7. When the presser foot assembly 60 of the programmable sewing machine 16 is repositioned to the material removal area (FIG. 5) by the software and control motors (not shown), the bracket 66 of the presser foot assembly 60 engages with a guard wire 140 (FIGS. 2–3) attached to the guard 132 which pivots the guard 132 away from the area through which the material removal device 120 travels so that material removal operations may be performed. However, when the presser foot assembly 60 moves to the position illustrated in FIG. 7 to perform sewing operations, the guard 132 pivots to a position around and below which the material removal device 120 normally travels to restrict its downward movement in the event it is inadvertently deployed. In this regard, the cutting head 128 may pass through a guard hole 136 on the bottom of the guard 132 so that it is not damaged, as best illustrated in FIG. 8. However, the shaft 124 of the material removal device 120 is of a larger diameter than the guard hole 136 and thus inhibits further downward movement of the material removal device 120.

In order to provide a suitable surface for the material removal device 120 to engage with during material removal operations, the support plate 44 (FIG. 1) is replaced with a table 112 (FIG. 2) which is detachably connected to the programmable sewing machine 16 in a position which is substantially adjacent to and parallel with the cylinder bed 36. However, the table 112 is isolated from the sewing area below the cylinder bed 36 by the casting of the sewing machine 16. Positioned within the table 112, as best illustrated in FIGS. 3, 5, and 6–8, is a recessed receiver 116 in which the cutting head 128 of the material removal device 120 enters after having fully passed through the stitchable material 144. In order to enhance cutting of the stitchable material 144, the upper portion of the receiver 116 may be contoured to provide a cutting edge.

An advantage of the structural configuration of the kit assembly 12 presented herein is that it is positioned a sufficient distance from the sewing drive assembly 48 and the sewing components assembly 52, including the sewing needle 56, so as to not interfere with their normal operations. Nonetheless, the kit assembly 12 may be positioned sufficiently close to the sewing area defined by the cylinder bed 36, more particularly the sewing needle 56 and the cylinder bed hole 40, so as to not adversely affect the overall speed of the material removal and sewing operations. In this regard and for a buttonhole application, preferably the distance between the centers of the recessed receiver 116 and the cylinder bed hole 40 will be about five (5) inches or less.

Installation of the kit assembly 12 typically requires little if any modification of the programmable sewing machine 16. When used with a programmable sewing machine of the type illustrated in FIG. 1, the head cover 28 is detached by removing the head cover screws 32 and the support assembly 92, which preferably is configured to substantially follow the contour of the end of the head 24, is mounted to the head 24. The head cover 28 may then be positioned on the end of the support assembly 92 and the head cover screws 32, or appropriate substitutes, may be positioned through the holes in the head cover 38, the support assembly 92, and programmable sewing machine 16. In order to complete the installation, the support plate 44 is removed and the table 112 is positioned substantially adjacent to and parallel with the cylinder bed 36 and is attached to the programmable sewing machine 16 in an appropriate manner by, for instance, two fasteners 148 (FIG. 3). Although material removal operations may be manually controlled, preferably the kit assembly 12 is integrated with the software of the programmable sewing machine 16 such that fully automated operations will be provided.

When the kit assembly 12 has been properly integrated with the controlling software for the programmable sewing machine 16 and material removal operations are to be initiated, the stitchable material is placed in the presser foot assembly 60 of the programmable sewing machine 16 between the upper presser foot or arch clamp 64 and the lower presser foot or bottom feed plate 72. Thereafter, the presser foot assembly 60 is engaged as is known in the art to firmly secure the stitchable material 144. Then the presser foot assembly 60, together with the stitchable material 144, is moved to the desired position for material removal operations as generally illustrated in FIG. 5. As the presser foot assembly 60 is repositioned over the table 112, the bracket 66 engages the guard wire 140 attached to the punch guard 132 such that it pivots away from the support assembly 92 into the position illustrated in FIG. 5.

Once the desired sewing pattern has been selected, the software sends a signal to the driver 104 to activate the material removal device 120. Consequently, the material removal device 120 is driven down through the upper and lower presser foot holes 68, 76, respectively, and the stitchable material 144 until the cutting head 128 enters the receiver 116 in the table 112. After the desired portion of the stitchable material 144 has been removed, the software directs the controllers (not shown) to retract the driver shaft 108 of the driver 104 and thus the material removal device 120.

After the material removal operations are completed, the presser foot assembly 60, as directed by the software and through use of the control motors (not shown), is moved laterally toward the cylinder bed 36 along the cylinder rod 88 to align the opening in the stitchable material 144 with the sewing needle 56. During this movement of the presser foot assembly 60, the guard 132 moves into the position illustrated in FIG. 7 since the bracket 66 of the presser foot assembly 60 no longer exerts a force on the guard wire 140.

When the stitchable material 144 is properly positioned relative to the sewing needle 56, the software directs the sewing drive assembly 48 to begin sewing operations through the sewing components assembly 52, including the sewing needle 56, as is well known in the art. Consequently, a pattern is sewn around and in the opening in the desired manner.

Once sewing operations are completed, the software directs the controllers (not shown) to move the presser foot assembly 60, together with the stitchable material 144, in a lateral direction along the cylinder rod 88 from the position illustrated in FIG. 7 back to the initial position generally illustrated in FIG. 5. When this movement is initiated, the sewing needle 56 is in an upward position as illustrated in FIG. 5 so as to not catch on the upper presser foot 64. Moreover, as the presser foot assembly 60 is repositioned over the table 112, the bracket 66 engages the guard wire 140 attached to the guard 132 such that it pivots away from the support assembly 92 into the position illustrated in FIG. 5 to allow material removal operations to be performed. Thereafter, the cycle of material removal and sewing operations may be repeated in the above-described manner.

Although the material removal and sewing operations has been described as such, it can be appreciated that the sequence may be reversed. In this regard, the sewing operations would first produce the desired stitching pattern on the stitchable material 144. Thereafter, material removal operations would be performed to remove portions of the stitchable material 144 inside of the area defined by the stitching pattern. Although the same general end product is obtained by both sequences, performing material removal operations after sewing operations results in a hole or opening not having a stitched border therearound, thereby exposing some fibers of the stitchable material 144.

As can be appreciated by those skilled in the art, after material removal and sewing operations are completed, the punch kit assembly 12 of may be disabled or entirely removed such that the programmable sewing machine 16 may be used for alternate functions. This is desirable since most programmable sewing machines are used for industrial applications and thus are quite expensive. Moreover, essentially no structural modification is required of the programmable sewing machine 16 to use the kit assembly 12 so that performance of the programmable sewing machine 16 is not adversely affected. Furthermore, material removal operations may take place sufficiently close to the sewing area in the case of the kit assembly 12 such that the overall speed of material removal and sewing operations is not adversely affected.

Figure 14:
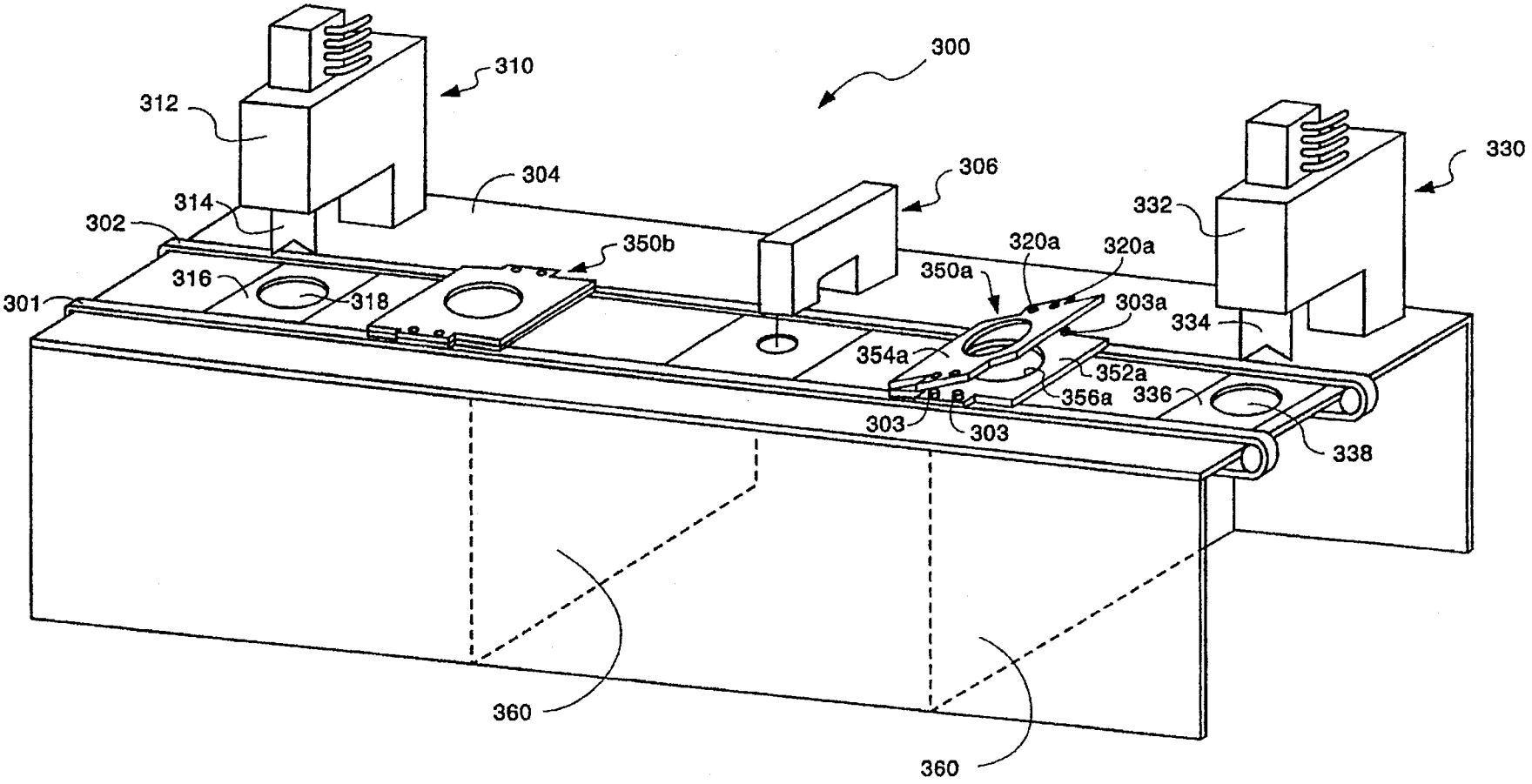
FIG. 14 is a perspective view of another embodiment of a sewing and material removal assembly.
Figure 15:
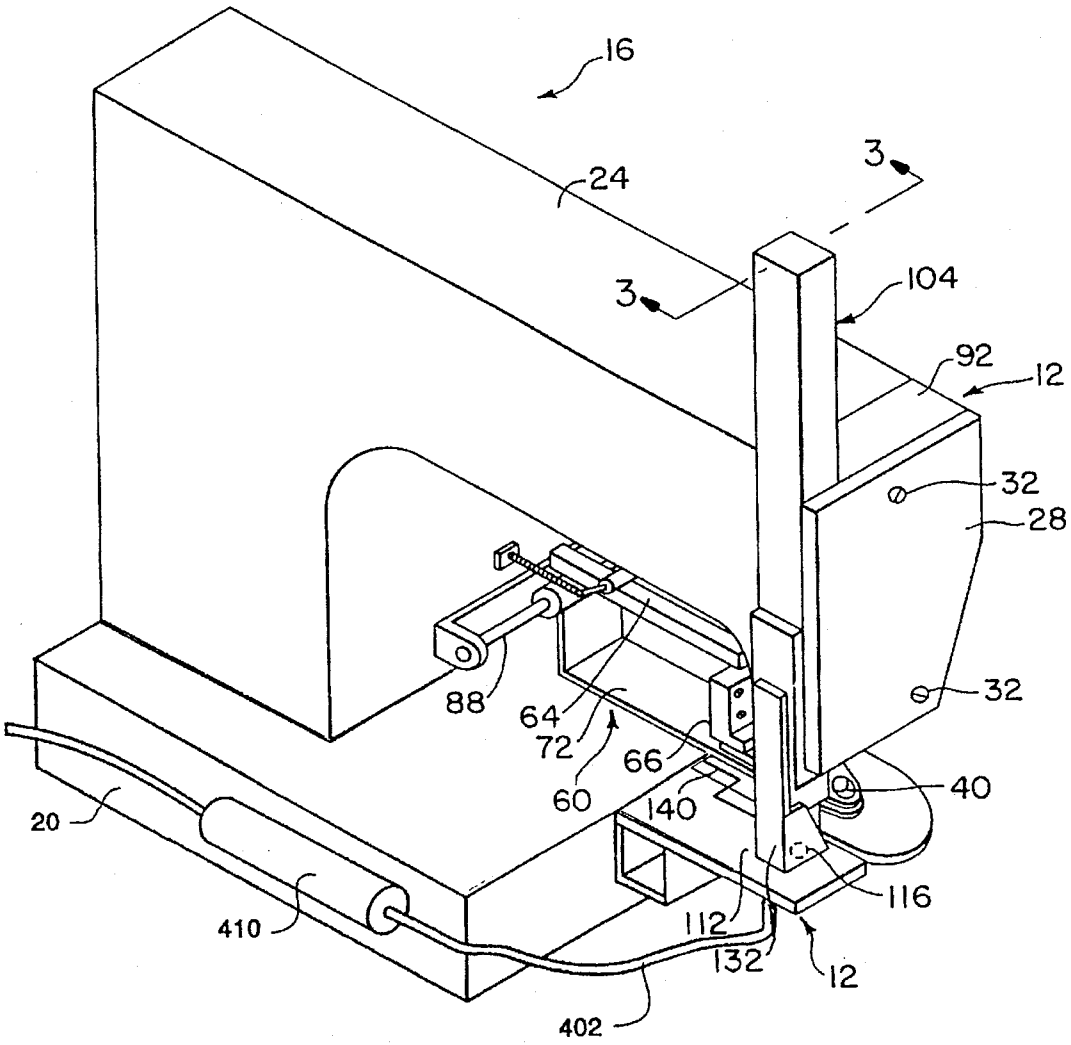
FIG. 15 is a perspective view of the assembly of FIG. 2 incorporating an alignment assembly.

Another material removal and sewing assembly is illustrated in FIG. 14. Generally, the material removal and sewing assembly 300 includes a first material removal unit 310 and a second material removal unit 330 which are laterally displaced on opposing sides of a sewing unit 306. The sewing unit 306 provides for sewing operations on one or more pieces of stitchable material (e.g., one or more overlapping plies), whereas each of the material removal units 310, 330 provide for material removal operations on such stitchable material. A transport assembly belt 302 integrates sewing and material removal operations by moving pallet clamps 350*a*, 350*b* along platform 304 between sewing unit 306 and material removal units 310, 330. Consequently, the transport assembly 302 also interconnects the sewing unit 306 with each of the material removal units 310, 330.

As in the case of the kit assembly 12 mounted on the programmable sewing machine 16, the material removal operations are again isolated from the sewing area. This may be provided by barriers 360 disposed on opposite sides of the sewing unit 306. Alternatively, the sewing unit 306 and each of the material removal units 310, 330 may each be contained within separate housings (not shown). In this case, there would be three physically separate machines (i.e., a sewing unit and two material removal units) which would then be appropriately interconnected to provide an assembly 300 with an automated integration of sewing and material removal operations. For instance, the platform 304 could be positioned on the upper surface of these separate machines and appropriately attached thereto, and the platform 304 could incorporate the transport assembly 302.

As noted, the assembly 300 has the sewing unit 306, although more could be incorporated if desired to further enhance production capabilities. Nonetheless, the sewing unit 306 is preferably a programmable sewing machine analogous to the machine discussed above, and thus is able to provide automated sewing operations for the assembly 300. Moreover, each material removal unit 310, 330 is principally similar to the kit assembly 12 discussed above for providing automated material removal operations for the assembly 300. However, the spacing between the sewing unit 306 and each of the material removal units 310, 330 is increased over that disclosed above with regard to the kit assembly 12 to accommodate, for instance, for different applications.

The first and second material removal units 310, 330, respectively, include a head 312, 332, respectively, which houses a material removal device or punch 314, 334, respectively, for removing portions of stitchable material from a given work-piece in a predetermined pattern. Each punch 314, 334 is preferably threadedly engaged with the respective material removal unit 310, 330 or otherwise detachable therefrom to allow punches of different sizes and geometric configurations to be used with the material removal units 310, 330. It will be appreciated that a plurality of punches may be utilized by each material removal unit 310, 330 (not shown), for instance, to punch a predetermined pattern of a plurality of holes in one or more pieces of stitchable material. Regardless if one or more punches are used, such may be driven in the above-described manner, either individually or via mounting on a common structure which is then appropriately driven.

Each material device 310, 330 also includes a removable punch table 316, 336 having a bore 318, 338 positioned beneath punch 314, 334 to receive a portion of punch 314, 334 during a punching operation. The diameter of each bore 318, 338 is preferably slightly larger than the outer diameter of punch 314, 334 to allow a portion of the associated punch 314, 334 to pass through the bore 318, 338 during a material removal operation. As will be appreciated, punch tables 316, 336 having bores of different sizes and configurations may be required to accommodate punches 314, 334 of different sizes and shapes. Moreover and in the case where multiple punches are used to produce a predetermined pattern of a plurality of holes in one or more pieces of stitchable material, multiple bores may be utilized with one being aligned with each associated punch.

The transport assembly 302 transfers the stitchable material between the material removal units 310, 330 and the sewing unit 306. The transport assembly 302 includes a conveyor belt 301 and pallet clamps 350. Each pallet clamp 350 includes a lower member 352 and an upper member 354 for retaining one or more overlapping pieces of stitchable material therebetween. In order to appropriately interconnect the conveyor belt 301 and the pallet clamps 350, the conveyor belt 301 includes pegs 303 which pass through positioning holes 320 in the upper members 352 and lower members 354 of the pallet clamps 350.

The pallet clamps 350 retain the one or more pieces of stitchable material during material removal and sewing operations, and also allow for an automated transfer of such materials between the sewing unit 306 and the material removal units 310, 330. In this regard, each pallet clamp 350 further includes a bore 356. This bore 356 allows a punch (es) from one of the material removal units 310, 330 to pass through the pallet clamp 350 and thus perform material removal operations on the one or more pieces of stitchable material therein, as well as allows the sewing needle of the sewing unit 306 to perform sewing operations on such one or more pieces of stitchable material while positioned in the pallet clamp 350. As will be appreciated, pallet clamps 350 having differently sized and shaped bores may be used with punches of different sizes and shapes.

The sewing and material removal assembly 300 provides for a desired automation of sewing and material removal operations and with an increased production capacity. That is, the sewing unit 306 alternately receives materials from the material removal units 310, 330 for performing sewing operations thereon. One such sequence which could be used is as follows. Initially, with the conveyor belt 301 in the position illustrated in FIG. 14 and while in a stationary condition, the operator (not shown) unloads the one or more pieces of stitchable material from the pallet clamp 350*a* after sewing and material removal operations have been performed thereon. The pallet clamp 350*b* has one or more pieces of stitchable material positioned thereon (not shown) and has already had material removal operations performed thereon at the material removal unit 310. The operator places one more pieces of stitchable material in the pallet clamp 350*a*. More specifically, one or more pieces of stitchable material are positioned on the lower member 352*a* of the pallet clamp 350*a* and its upper member 354*a* is then closed over the lower member 352*a* to secure the one or more pieces of stitchable material in place. Thereafter, the operator may initiate a cycle by providing a signal to the assembly 300 which causes the conveyor belt 301 to moves the pallet clamp 350*a* under the material removal unit 330 and to simultaneously move the pallet clamp 350*b* under the sewing unit 306. After the material removal device 330 and sewing machine 306 have completed their respective operations on the materials in the pallet clamps 350*a*, 350*b*, respectively, the controlling software moves the conveyor belt 301 back to the position illustrated in FIG. 14 at which time the one or more pieces of stitchable material from the pallet clamp 350*b* are removed therefrom (having one or more holes formed therein with an associated sewing pattern), and one or more pieces of new stitchable material are loaded in the pallet clamp 350*b* in the above-described manner. The pallet clamp 350*a* remains in this position with its stitchable material being retained therein. The above sequence is then repeated, namely the stitchable material in the pallet clamp 350*a* and with one or more holes formed thereon is provided to the sewing unit 306 for the performance of sewing operations thereon, while the pallet clamp 350*b* is disposed in alignment with the material removal unit 310 for performance of material removal operations thereon. Although the sewing and material removal sequence has been described as such, those skilled in the art will appreciate that the sequence and/or the timing thereof may be modified. For instance, once the cycle is initiated the conveyor belt 301 may stall for a predetermined period of time in the position illustrated in FIG. 14 to allow a given pallet clamp 350 to be unloaded with a finished product and reloaded with new stitchable materials. Moreover, although the assembly 300 has been described with regard to two material units 310, 330 which alternately feed a common sewing unit 306, such is not required for all aspects of the present invention.

Further aspects of the material removal operation are illustrated in FIGS. 9–13, which specifically disclose an embodiment for efficiently removing material portions of a stitchable material and then carrying away and preferably disposing of such removed portions. As can be appreciated, when removing material portions of heavy-duty stitchable materials (e.g., multiple plies, thicker materials, resilient materials), an increased amount of force may be required to drive the material removal device 120 discussed above through such materials, particularly if the portion of the cutting head 128 of the material removal device 120 which interacts with the stitchable material is a substantially continuous planar surface (e.g., a blunt-nosed configuration). Consequently, the material removal device 160 of FIGS. 9–10 utilizes a hollow configuration which reduces the area of contact between the stitchable material and the material removal device 160 to effectively an edge, thereby providing for an enhanced "cutting" action and more efficient penetration.

The material removal device 160 utilizes a hollow tubular configuration and V-shaped portions 164 are positioned on opposite sides of the device 160 such that there are two points 168 which first engage the stitchable material for a more effective initial separation thereof. Moreover, the V-shaped portions 164 define four cutting edges 172 (only three shown) which taper outwardly from the points 168 to further enhance the separation of the stitchable material as the material removal device 160 is driven downwardly through the stitchable material. Although the material removal device 160 may be formed from a variety of materials, preferably the device 160 is metal which improves its durability and allows for the provision of sharp cutting edges 172. Moreover, as can be appreciated the diameter and/or end configuration of the hollow material removal device 160 may be varied depending upon criteria such as the given applications requirements. For instance, the material removal device 160 is substantially circular with an outside diameter ranging from about ⅛ inch to about ¼ inch.

Figure 11:
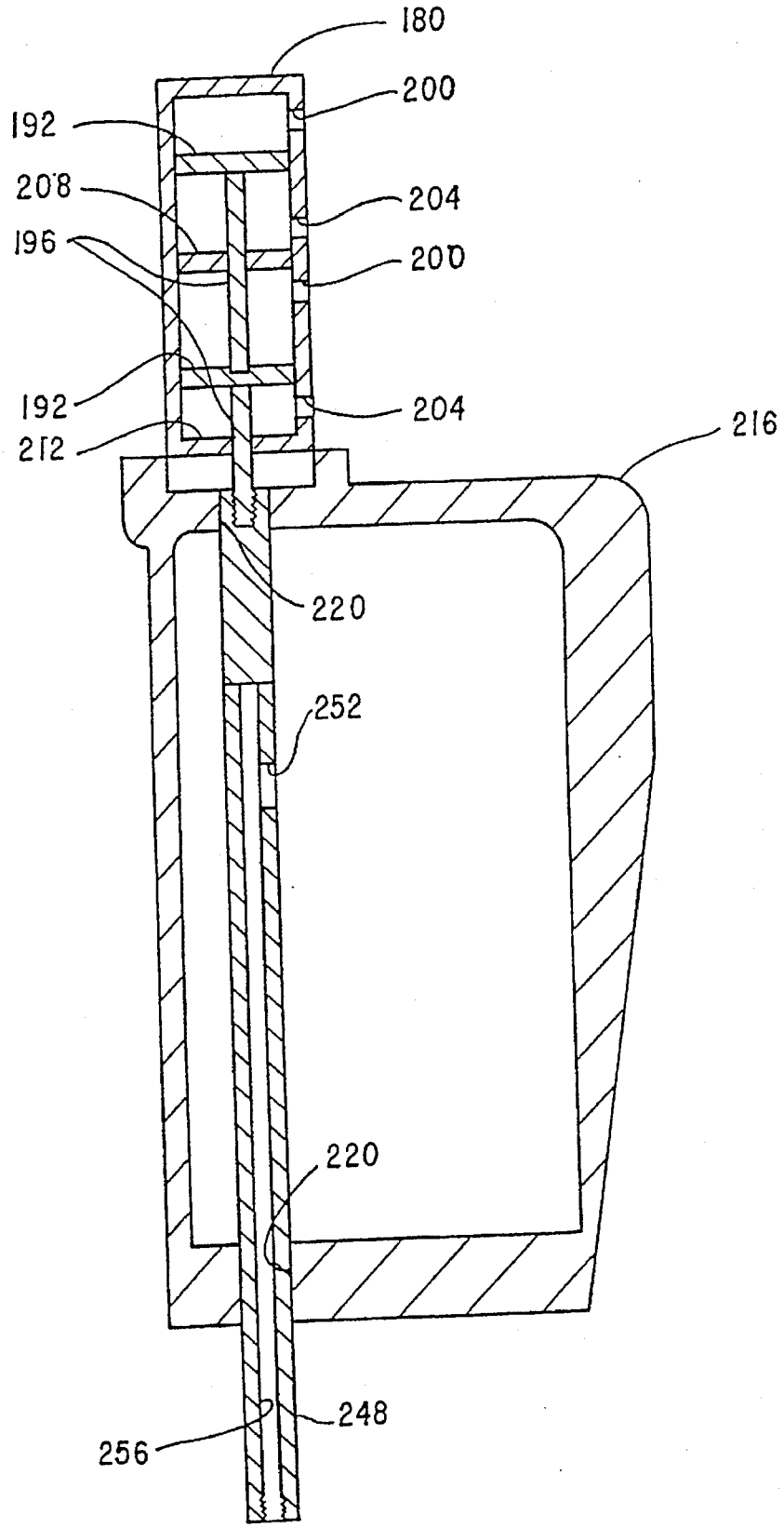
FIG. 11 is a cross-sectional view of one embodiment of a drive assembly for material removal operations which utilizes a system for carrying away the removed portions.

The material removal device 160 is driven downwardly into engagement with the stitchable material to remove material portions thereof. Although a number of drive mechanisms for performing this function would be appropriate, FIG. 11 illustrates a drive assembly 180 which is particularly suitable based upon the portion disposal system 244 which is preferably used with the material removal device 160 as will be discussed below.

The drive assembly 180 is appropriately mounted on a support assembly 216. The support assembly 216 preferably approximates the contour of an end portion of the head 24 of the programmable sewing machine 16 (FIG. 1) such that the assembly 216 may be attached thereto in a manner similar to support assembly 92 discussed above. The drive assembly 180 utilizes two chambers 188 in a "series" configuration (i.e., stacked), the chambers 188 being separated by a partition 208. Each chamber 188 has a piston 192 slidably positioned therein with a piston shaft 196 being attached to each of the pistons 192 to transfer the motion of such pistons 192 to a desired object. In this regard, the uppermost piston shaft 196 extends through the partition 208 and engages the lowermost piston 192 in an appropriate manner. The piston shaft 196 of the lowermost piston 192 extends through the bottom 212 of the drive assembly 180 to engage the connecting shaft 248 which is used to transfer the motion of the pistons 192 to the material removal device 160. Consequently, the pistons 192 and thus the piston shafts 196 are capable of simultaneous movement to govern movement of the material removal device 160.

The drive assembly 180 is a dual action configuration in that each chamber 188 has an upper and lower port 200, 204. Consequently, conduits (not shown) may be connected to the upper and lower ports 200, 204 to supply a medium to alternately act against the opposite sides of the pistons 192 at the appropriate times and thus achieve the desired downward and upward motion for the material removal device 160. Although various mediums may be employed, preferably a pneumatic system (not shown) is utilized for driving the pistons 192 through this downward/upward cyclic motion.

The simultaneous movement of the pistons 192 is transferred to the connecting shaft 248 which has the material removal device 160 attached at its opposite end. The lowermost piston shaft 196 may engage the upper end of the shaft 248 by various appropriate manners, such as threaded engagement. The material removal device 160 may also be similarly attached to the lower end of the shaft 248. In order to stabilize the connecting shaft 248 and limit the deflection thereof when engaged in material removal operations, the shaft 248 and/or the lowermost piston shaft 192 pass through a bore 220 in the upper and lower portions of the support assembly 216. Although not shown, a sleeve bearing may again be utilized in the bores 220 to reduce the frictional engagement of the shaft 248 and/or piston shaft 196 with the support assembly 216.

Based upon the hollow configuration of the material removal device 160 and the downward direction in which the device 160 moves when removing portions of stitchable material, there may be a tendency for the removed portions to move up within the hollow interior of the device 160. After an extended period of operation, the potential for a plurality of such removed portions filling or becoming jammed within the entire interior portion of the material removal device 160 increases, which could adversely effect material removal operations. In order to reduce this potential, the material removal device 160 is preferably used in combination with the portion disposal system 244 illustrated in FIGS. 11 and 12.

The portion disposal system 244 carries away the removed portions of stitchable material. A portion of the disposal system 244 is incorporated within the drive assembly 180 discussed above in that the connecting shaft 248, which is again used to transfer the motion of the pistons 192 to the material removal device 160, has an inner cavity 256 which extends along a portion of the length of the shaft 248 and which is in communication with the hollow interior of the material removal device 160. A port 252 extends through a wall of the shaft 248 in an appropriate location to interact with this cavity 256. Consequently, an appropriate conduit (not shown) may be positioned within the port 252 such that an appropriate medium may be forced through the inner cavity 256 to discharge the removed material portions from the end of the material removal device 160 at the appropriate time. As can be appreciated, such removed portions could also be withdrawn from the interior of the hollow material removal device 160 by a suction-type action.

Figure 12:
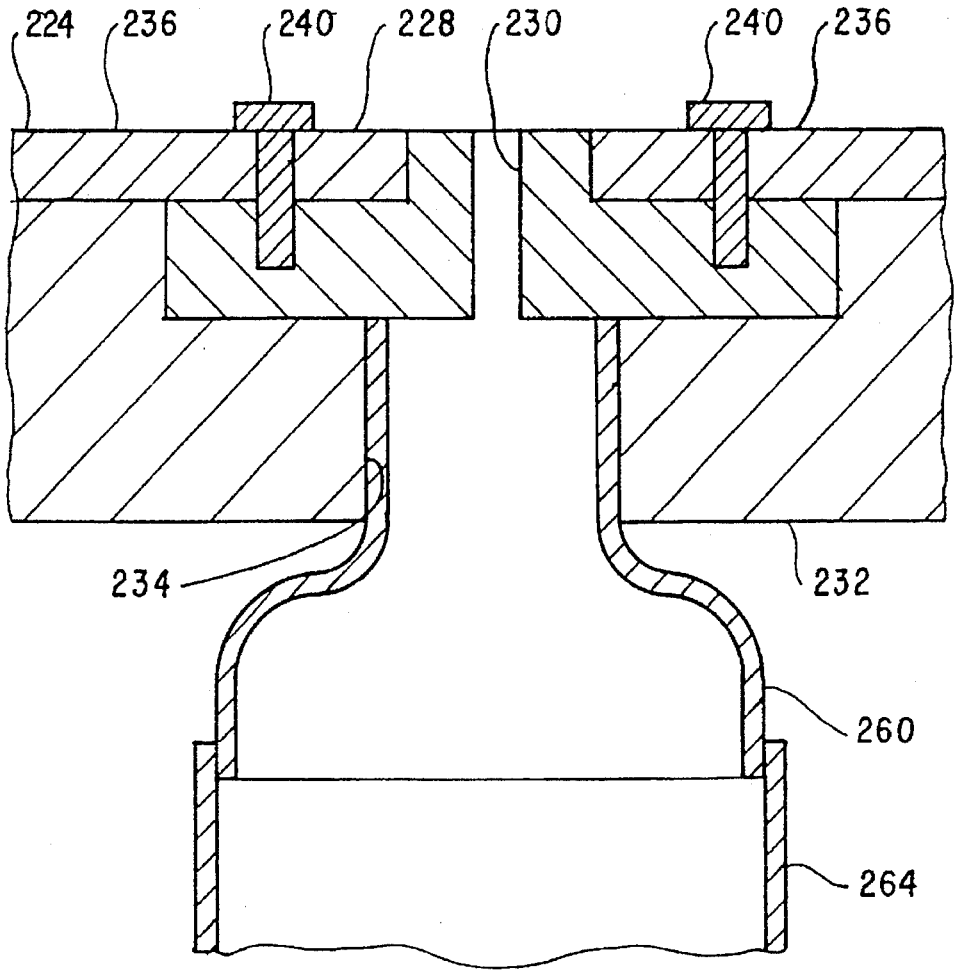
FIG. 12 is one embodiment of a table for interacting with the material removal device and which incorporates a part of a portion disposal system.
Figure 13:
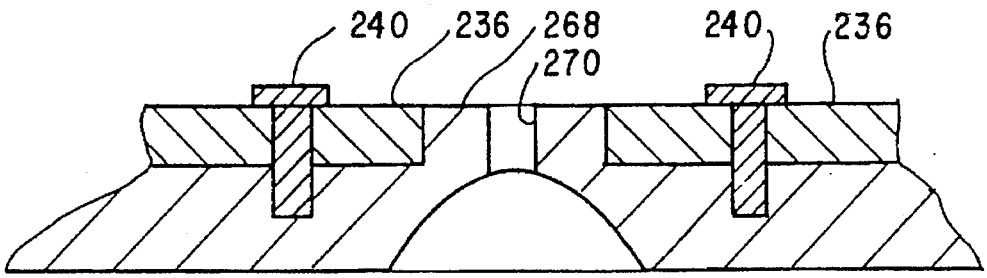
FIG. 13 is one embodiment of a table for interacting with a light duty material removal device.

In order to allow for the collection of the removed portions of stitchable material, the above-described table 112 and receiver 116 are modified. FIG. 12 illustrates the pertinent portions of the table 224 which accommodates for use of the portion disposal system 244, the remainder of the table 224 being substantially similar to the table 112 described above for similar attachment to the programmable sewing machine 16 (e.g., such that the table 224 is substantially parallel with and adjacent to the cylinder bed 36). The table 224 includes an insert 228 with a bore 230 therethrough such that the shaft 248 and the attached material removal device 160 may travel within the bore 230 during material removal operations. The insert 228 is seated within a base 232 and is secured therein by positioning plates 236 over portions of the insert 228 and by engaging the plates 236, insert 228, and base 232 with screws 240.

A bore 234 within the base 232 is substantially aligned with the bore 230 in the insert 228. A bell-shaped adapter 260 is positioned and secured within the bore 234, such as by threaded engagement, in order to interconnect the bore 234 and a conduit 264 attached to the adapter 260. The removed portions of stitchable material may therefore ultimately flow through the conduit 264 and be appropriately deposited. In this regard, the opposite end of the conduit 264 is preferably connected to an appropriate receptacle (not shown) which will contain the removed portions of stitchable material. Based upon the preferred medium used by the portion disposal system 244, namely forced air, this receptacle is preferably formed from a material which will allow the medium to pass there through but which will retain the portions of stitchable materials, such as a cotton receptacle.

In summarizing the operation of the material removal operations when the material removal device 160 is used in combination with the portion disposal system 244, the pistons 192 of the drive assembly 180 will be in their uppermost positions within the respective chambers 188 prior to initiation of the. removal operations. When the stitchable material has been properly positioned for removal operations in the above-described manner, the medium, again preferably air, is provided through the upper ports 200 of the chambers 188 to drive the pistons 192 in a downward direction. Consequently, the shaft 248 and material removal device 160 are also driven in a downward direction such that the material removal device 160 penetrates and passes through the stitchable material to remove material portions thereof. As a result, the material removal device 160 enters the bore 230 of the insert 228.

As can be appreciated, when heavy duty stitchable materials are being subjected to the above-described material removal operations, particularly when relatively thick materials are being used, it may be necessary for the length of the bore 230 to be sufficiently long since there may be a tendency for these thicker materials to stretch during material removal operations. In this regard, a length of approximately ¼ inch for the bore 230 will accommodate for this stretching in most applications. However, when relatively light materials are subjected to material removal operations, the insert 268 of FIG. 13 may be utilized in which the length of the corresponding bore 272 therein is approximately 1/16 of an inch and is formed by doming out the lower portion of the insert 276. This insert 276 may be used in the base 232 discussed above (i.e., such that the portion disposal system 244 may be used therewith) or the insert may be used without the portion disposal system 244, such as in the above-described embodiment of the kit assembly 12 for removing material portions of stitchable material.

Once a material portion of the stitchable material has been removed in accordance with the above process, the portion disposal system 244 may be activated to carry away the removed portion. In this regard, a medium, again preferably air, in forced through the port 252 in the shaft 248 such that the air will pass through the inner cavity 256 and the material removal device 160 to propel the removed portion from the end of the device 160. Thereafter, the removed portion passes through the adapter 260 and conduit 264 to an appropriate receptacle (not shown) as discussed above.

A number of alternatives may be utilized for the sources of the mediums for moving the pistons 192 and for use in the portion disposal system 244. In a preferred embodiment, a pneumatic supply system (not shown) is utilized and separate lines (not shown) are used to supply air to the chambers 188 and the portion disposal system 244. This allows the pressure of air supplied to the chambers 188 and the disposal system 244 to be controlled independently. However, the air which is used to drive the pistons 192 in the downward direction, which is evacuated from the chambers 188 when air is applied to the lower ports 204 to reinitialize the positioning of the pistons 192 and thus the material removal device 160 after a single removal operation is completed, may be used to provide the air used by the portion disposal system 244. In this regard, a conduit (not shown) would interconnect one or both of the upper ports 200 with the port 252 in shaft 248 of the disposal system 244.

The above-described drive assembly 180 and portion disposal system 244 may also of course utilize well known electronic or other sensing techniques such that material removal operations and the disposal of the removed portions can be performed in an automated manner, together with the sewing operations, so as to take full advantage of the capabilities of the programmable sewing machine 16. Consequently, the portion disposal system 244 can be activated via these sensing capabilities (i.e., air supplied through the inner cavity 256 of the shaft 248 and through the interior of the material removal device 160) simultaneously with the contacting of the stitchable material by the material removal device 160 or soon thereafter. Preferably, however, the portion disposal system 244 is not activated until the material removal device 160 has completely passed through the stitchable material. This not only may assist in the retraction of the pistons 192, but it reduces the potential for the forced air having an adverse effect on the material removal operations. For instance, in the event that air is provided to the disposal system 244 prior to the material removal device 160 contacting the stitchable material, not only does this provide a braking action to the downward motion of the material cutting device 160 (i.e., by working against the action of the device 160), but it may also undesirably disturb and/or disfigure the stitchable material.

Although the portion disposal system 244 has been described with regard to using a table 224 and support assembly 216 which are detachably connectable to a programmable sewing machine 16 to in effect provide a kit for use with existing machines 16, which again does not require significant modification thereof, the portion disposal system 244 may of course be used with other material removal operation apparatus. For instance, the described portion disposal system 244 may be utilized on a programmable sewing machine 16 in which the casting of the machine 16 is formed to accommodate the permanent incorporation of a material removal system (i.e., a machine 16 in which the cylinder bed 36 effectively incorporates the table 216 and in which the head 24 permanently incorporates the drive assembly 180 for the material removal device 160).

Although the portion disposal system 244 has been described with reference to the use of air for carrying away the removed portion of stitchable material, those skilled in the art will also appreciate that a number of alternatives exist for displacing the removed portion of stitchable material from an end of the material removal device 160. For instance, other pressurized fluids may be utilized. Moreover, the removed portion may be mechanically displaced from the material removal device 160. More particularly, a rod may be propelled through the interior portion of the material removal device 160 by an appropriate drive assembly.

Each of the above-identified embodiments of material removal devices may further include an assembly for aligning the stitchable material relative to the material removal device. That is, in certain applications the stitchable material which is to have material removal and sewing operations performed thereon already has one or more guide holes formed therein. The described alignment feature thereby improves upon the accuracy of the placement of the hole(s) in the stitchable material, as well as the sewing pattern around this hole(s).

Referring to FIG. 15–18, one embodiment of an alignment assembly 398 is illustrated therein as such could be integrated with the material removal device 160 and portion disposal system 244 of FIGS. 9–13. The alignment assembly 398 generally includes a cable 402 having a wire 404 slidably positioned therein. One end of the wire 404 is interconnected with a reciprocable piston of a pneumatic cylinder 410 which is mounted on the sewing machine 16. A second end of the wire 404 is aligned with the bore 230 in the table 224 through which the material removal device 160 travels. Consequently, as the piston of the cylinder 410 reciprocates in a predetermined manner between two positions (e.g., as controlled by appropriate software), the wire 404 moves relative to the cable 402 and the table 244 between two positions. In the alignment position of FIG. 16, the wire 404 extends above the surface of the table 244, and thus is in the path of travel of the material removal device 160. In the retracted position of FIG. 17, the wire 404 is below the table 244 and out of the path of travel of the material removal device 160 so as to not interfere with its operation.

Figure 18:
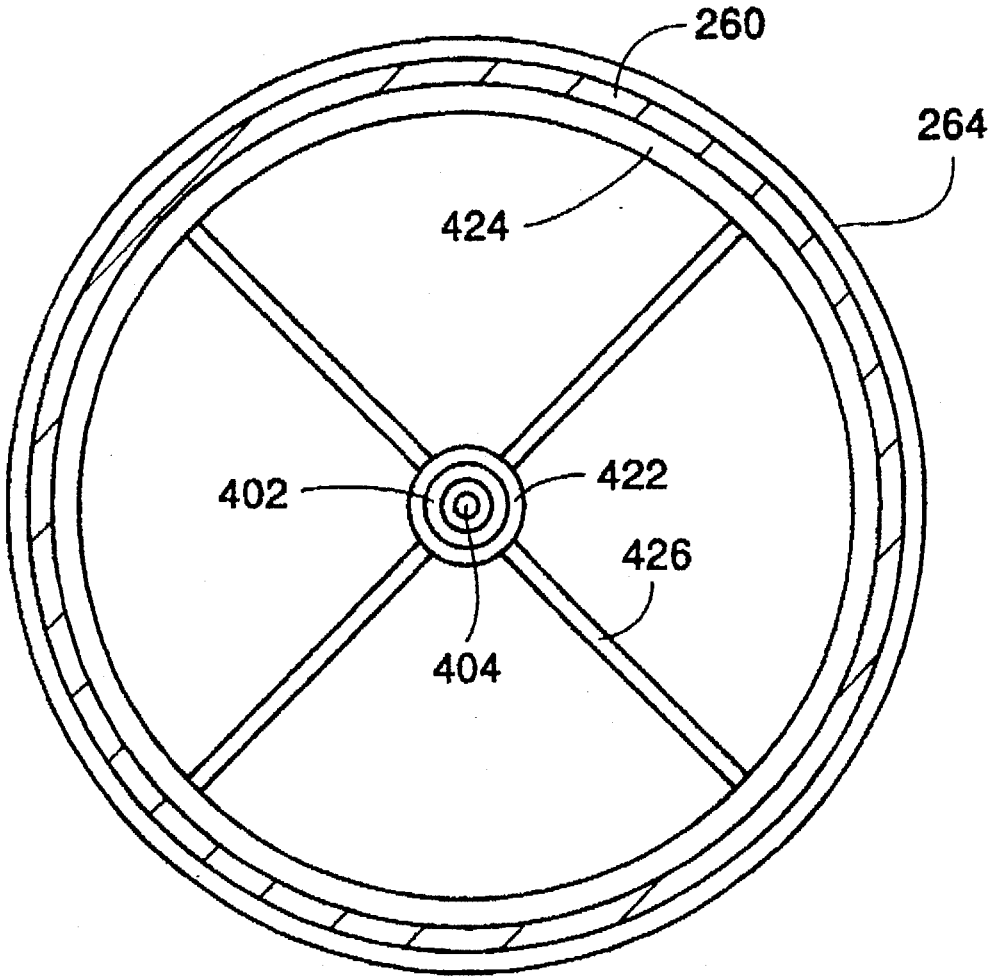
FIG. 18 is a cross-sectional view of the alignment assembly of FIG. 17 taken along lines 400—400.

As can be appreciated, the manner in which the alignment assembly 398 is incorporated should not interfere with the operation of the portion disposal system 244. In one embodiment, the cable 402 extends through conduit the 264 and is secured to the bell-shaped adapter 260 by a bracket or a clamp assembly 420, and thus is maintained in a fixed position relative to the base 232 of the table 224. As illustrated in FIG. 18, the bracket assembly 420 preferably includes a centrally disposed annular hub 422, and an annular rim 424 connected by a plurality of spokes 426 extending radially from the hub 422 to the rim 424. The cable 402 is appropriately secured to the hub 422 and thus the wire 404 may move relative thereto. Moreover, since there is a space between adjacent spokes 426 this interconnects the alignment assembly 398 without interfering with material disposal operations as described above.

Figure 16:
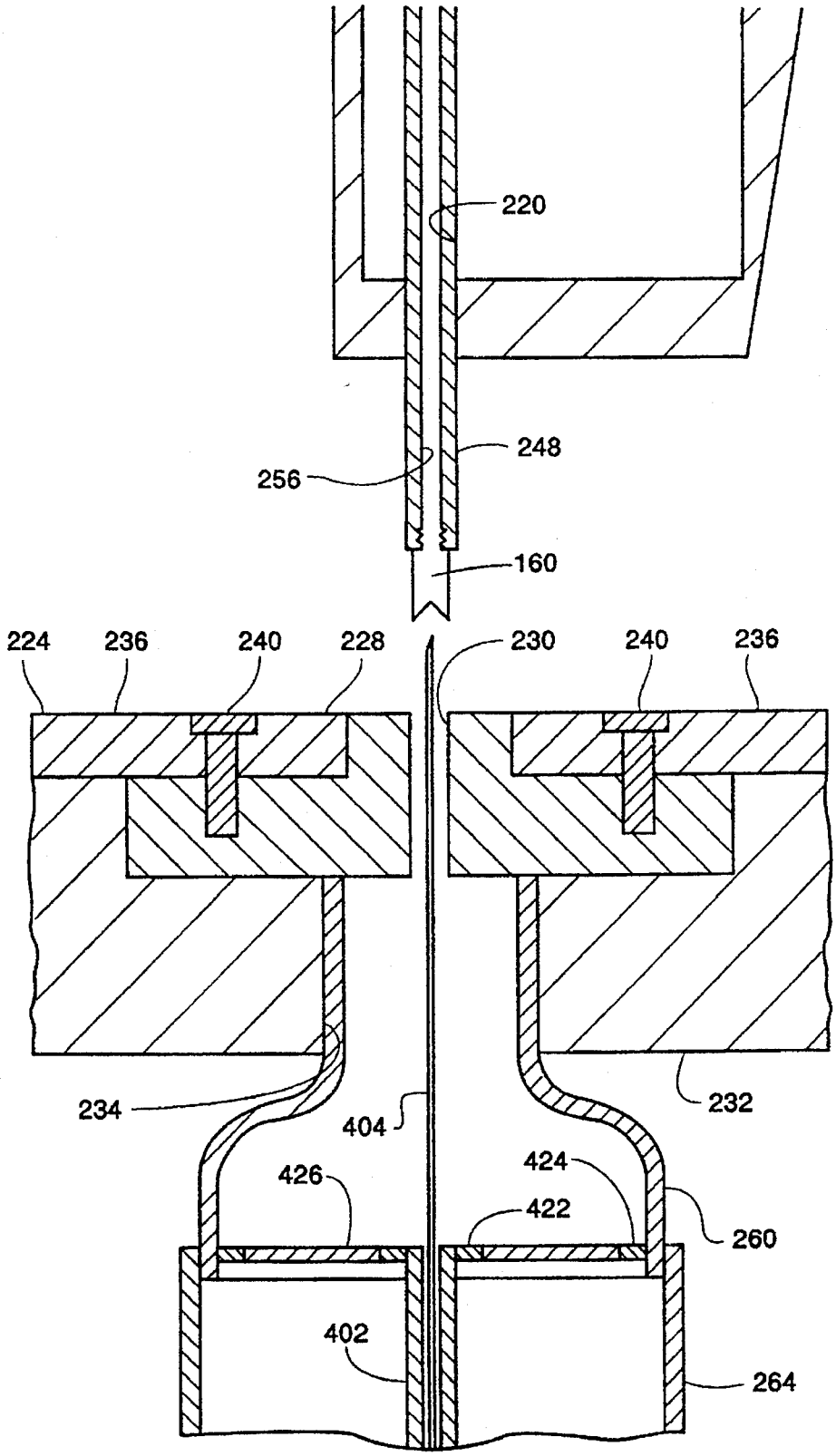
FIGS. 16 and 17 are cross-sectional views of the table of FIG. 12 incorporating the alignment assembly of FIG. 15.

In operation, the alignment assembly 398 is placed in a first position as illustrated in FIG. 16 and the stitchable material is positioned on the portion of wire 404 extending above base 232 using pre-existing guide or positioning holes in the stitchable material. The wire 404 is advanced relative to the cable 402 and the table 244 into this position by activation of the cylinder 410, more particularly by movement of its piston to a predetermined location. In this position, the wire 404 is once again in the path through which the material removal device 160 passes when performing material removal operations on the one or more pieces of stitchable material.

Figure 17:
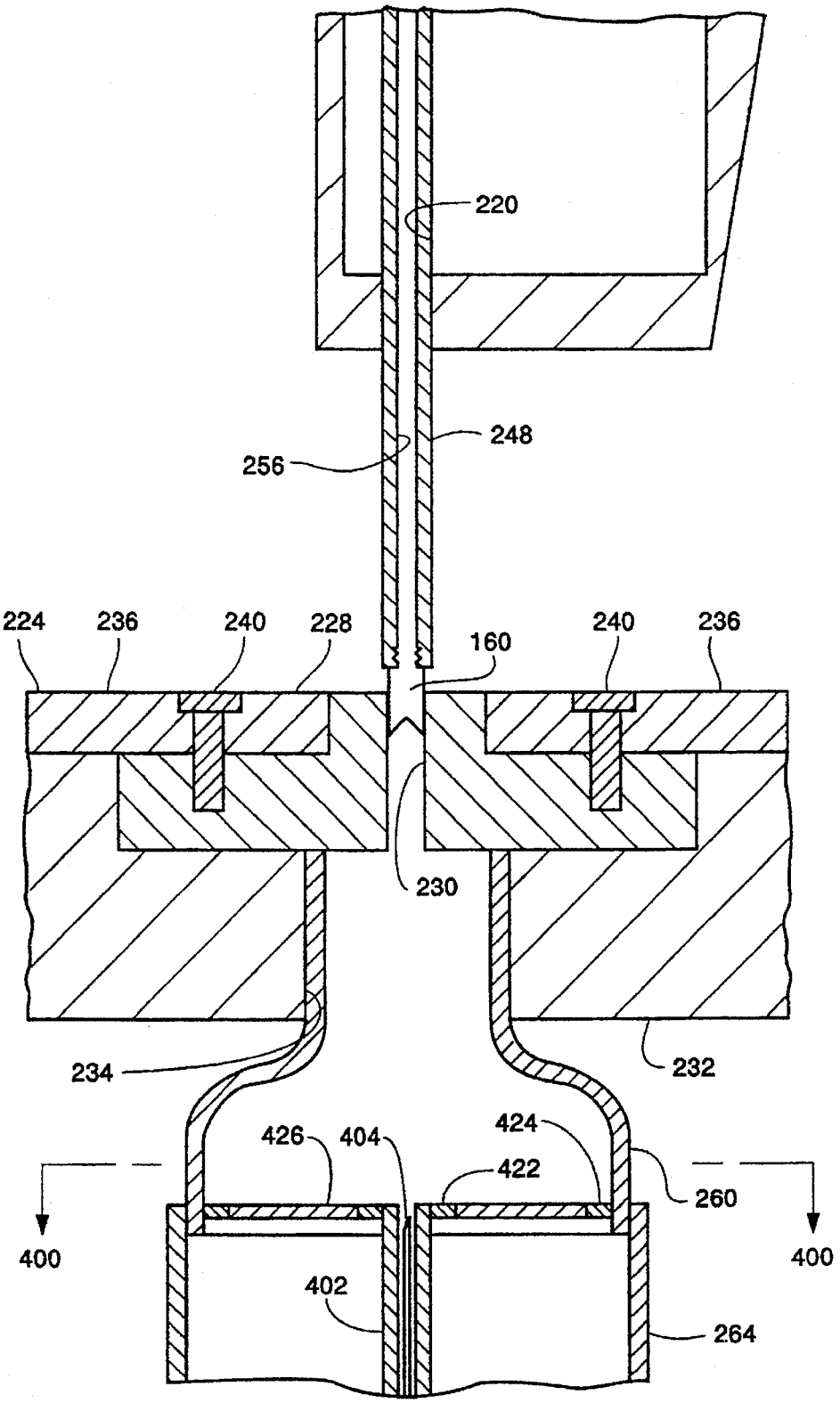

After the one or more pieces of stitchable material are mounted on the wire 404 when in the position illustrated in FIG. 16, the wire 404 is retracted beneath the surface of the table 244 and to a location which is outside of the path of travel of the material removal device 160 so as to not interfere with material removal operations as illustrated in FIG. 17. This movement of the wire 404 is affected by activation of the cylinder 410, more particularly by movement of its piston to another predetermined location which thereby moves the wire 404 relative to the cable 402 and the table 244. Thereafter, material removal and sewing operations may be performed in the above-described manner.

Notwithstanding the foregoing description of how the wire 404 may be moved between the two noted positions, it will be appreciated that other appropriate mechanisms may be utilized. For instance, the wire 404 may be appropriately interconnected with the presser foot or arch clamp assembly 60 of the programmable sewing machine 16. More particularly, when the upper presser foot or arch clamp 64 moves down into engagement with the stitchable material prior to the performance of material removal operations, an appropriate linkage between the upper presser foot 64 and the wire 404 could retract the wire 404 into the position illustrated in FIG. 17. Moreover, when the upper presser foot or arch clamp 64 is raised, for instance to allow for the removal of stitchable material after sewing operations have been completed and/or to insert one or more new pieces of stitchable material for the performance of material removal and sewing operations thereon, the noted linkage would raise the wire 404 into its alignment position as illustrated in FIG. 16.

In addition to the foregoing, it will be appreciated that other mechanical devices may be used to perform the alignment function noted herein. For instance, instead of a wire 404 a pin or the like of sufficient rigidity could be used and moved between the two noted positions to provide an alignment function. Moreover, although only one alignment device is illustrated, it will be appreciated that multiple alignment devices may be used if multiple guide holes are provided in the stitchable material for indicating the location of the desired holes. That is, an alignment assembly may include multiple members which are movable between the two noted positions. Furthermore, it will be appreciated that the alignment assembly 398 may be used when a guide hole(s) is present in the one or more pieces of stitchable material wherein the size of such hole(s) is increased by the material removal device 160, or the alignment assembly 398 may be used to align a prepunched hole at a location which is displaced from the sewing needle 56 of the sewing machine 16. That is, material removal operations need not necessarily be performed when using the alignment assembly 398.

Figure 20:
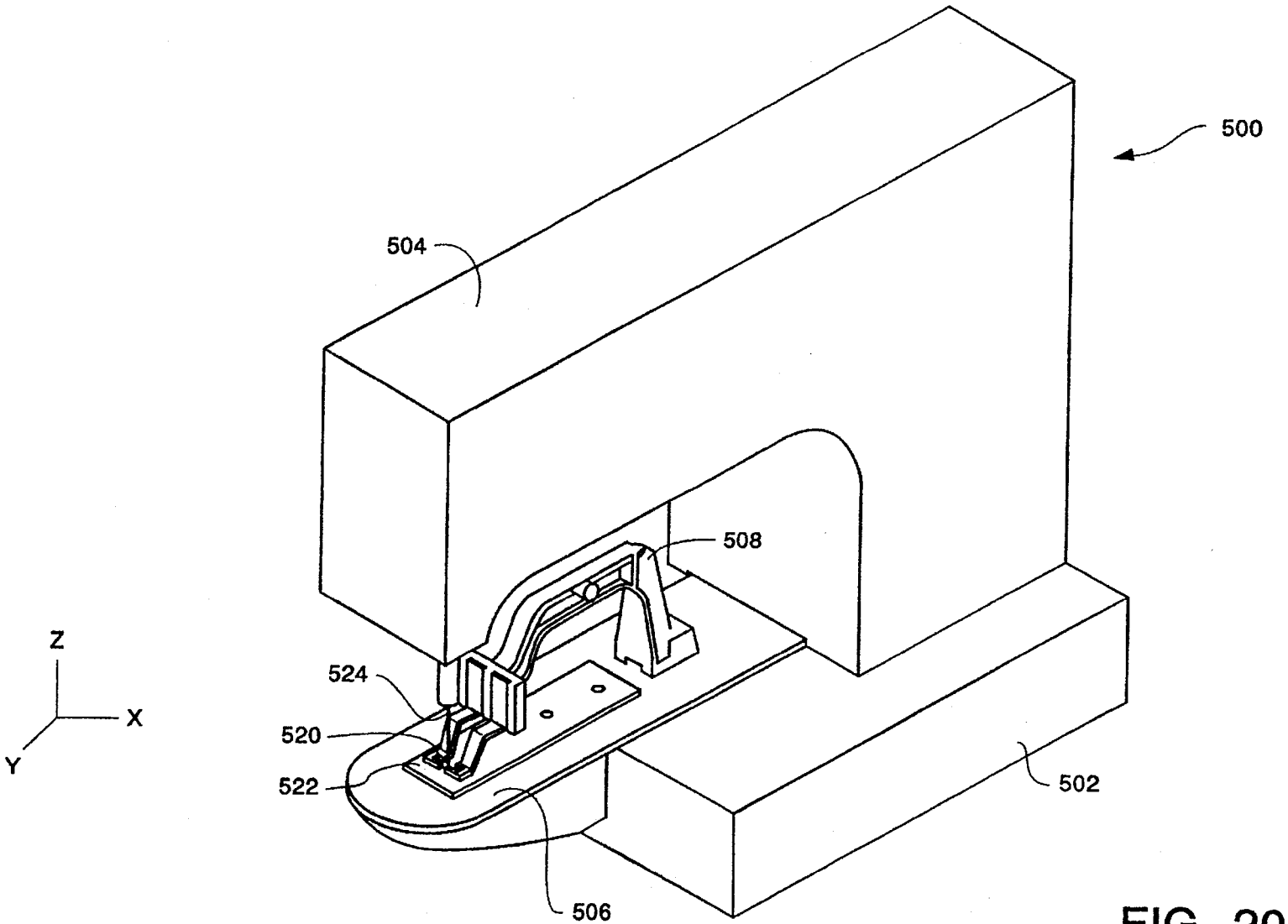
FIG. 20 is a perspective view of a cam-driven sewing machine.

As noted above, the kit assembly 12 of FIGS. 2–8 may also be adapted for use with a cam-driven pattern tacker sewing machine, and would be installed generally in the manner discussed above with regard to the programmable sewing machine 16. Referring to FIG. 20, a cam-driven pattern tacker sewing machine 500 is illustrated therein which includes a base 502 which functions as a support, a sewing head 504 which includes portions of the sewing drive assembly (e.g., the needle bar and not shown) for driving the sewing components of the sewing machine 500 and including a vertically reciprocable sewing needle 124, and a cylinder bed or throat plate 506 below which is positioned other sewing components which interact with the sewing needle 124 (e.g., a bobbin and not shown) to produce a desired stitch and which also serves as a support for the material to be stitched (not shown). An arch clamp 508, including an arch clamp foot 520 detachably connected to the front face of the arch clamp 508, together with a bottom feed plate 522 which is fixedly interconnected with the arch clamp 508 in a manner known in the art (e.g., typically that portion of the arch clamp drive assembly which provides for movement of the arch clamp 508 on the "x" and "y" dimensions), moves the material to be stitched relative to the vertically reciprocating sewing needle 524 to produce the desired stitching pattern.

The particular manner in which the arch clamp 508 and bottom feed plate 522 are advanced to move the stitchable material relative to the vertically reciprocable sewing needle 524 is well known in the art and will not be discussed in detail herein. However, generally a cam drive assembly (not shown) governs the movement of the arch clamp 508 in the "x", "y", and "z" dimensions. More specifically, the cam drive assembly controls the movement of the arch clamp 508 and the attached arch clamp foot 520 in the "z" dimension to compressively engage the stitchable material between the arch clamp foot 520 and the bottom feed plate 522 in preparation for sewing operations (e.g., the bottom feed plate 522 does not move in the "z" dimension), and subsequently to release the stitchable material to allow its removal from the sewing machine 500. Additionally, the cam drive assembly moves the arch clamp 508 and bottom feed plate 522 in a predetermined pattern in the "x" and "y" dimensions during sewing operations (e.g., when stitchable material is held between the arch clamp 508 and the bottom feed plate 522) to produce the desired stitching pattern.

Figure 21:
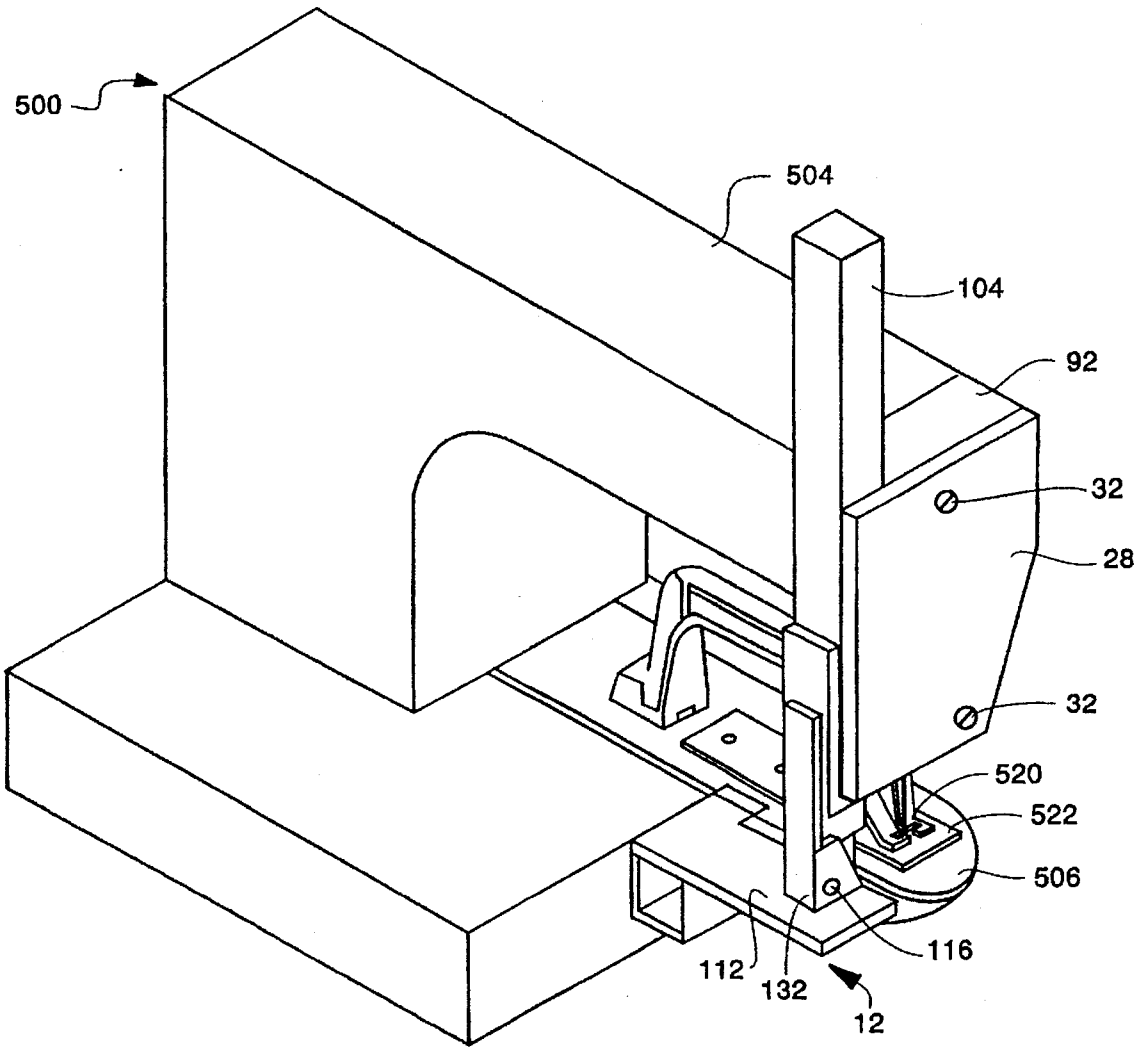
FIG. 21 is a perspective view of the cam-driven sewing machine of FIG. 20 incorporating a material removal unit.

Referring to FIG. 21, the kit assembly 12 is illustrated as being installed on the cam-driven sewing machine 500. As will be appreciated, when the kit assembly 12 is used in conjunction with the cam-driven sewing machine 500, the cam-drive assembly or some other interfacing drive assembly (including manual systems which would not be desirable as one which would have automating capabilities) should control the timing and operation of the kit assembly 12. Moreover, due to the operational distinctions between the cam-driven sewing machine 500 and the programmable sewing machine 16, both of which are again pattern tackers (e.g., the range of motion of the arch clamp of a cam-driven pattern tacker typically being limited to within the sewing area or that general area where sewing operations are performed, versus a programmable pattern tacker which has the ability to move the arch clamp outside of the sewing area as discussed above), an appropriate stitchable material transfer system must be utilized in order to provide for automated buttonhole or the like operations with the cam-driven sewing machine 500 and using the kit assembly 12, one of which is illustrated in FIGS. 22–28.

Figure 22:
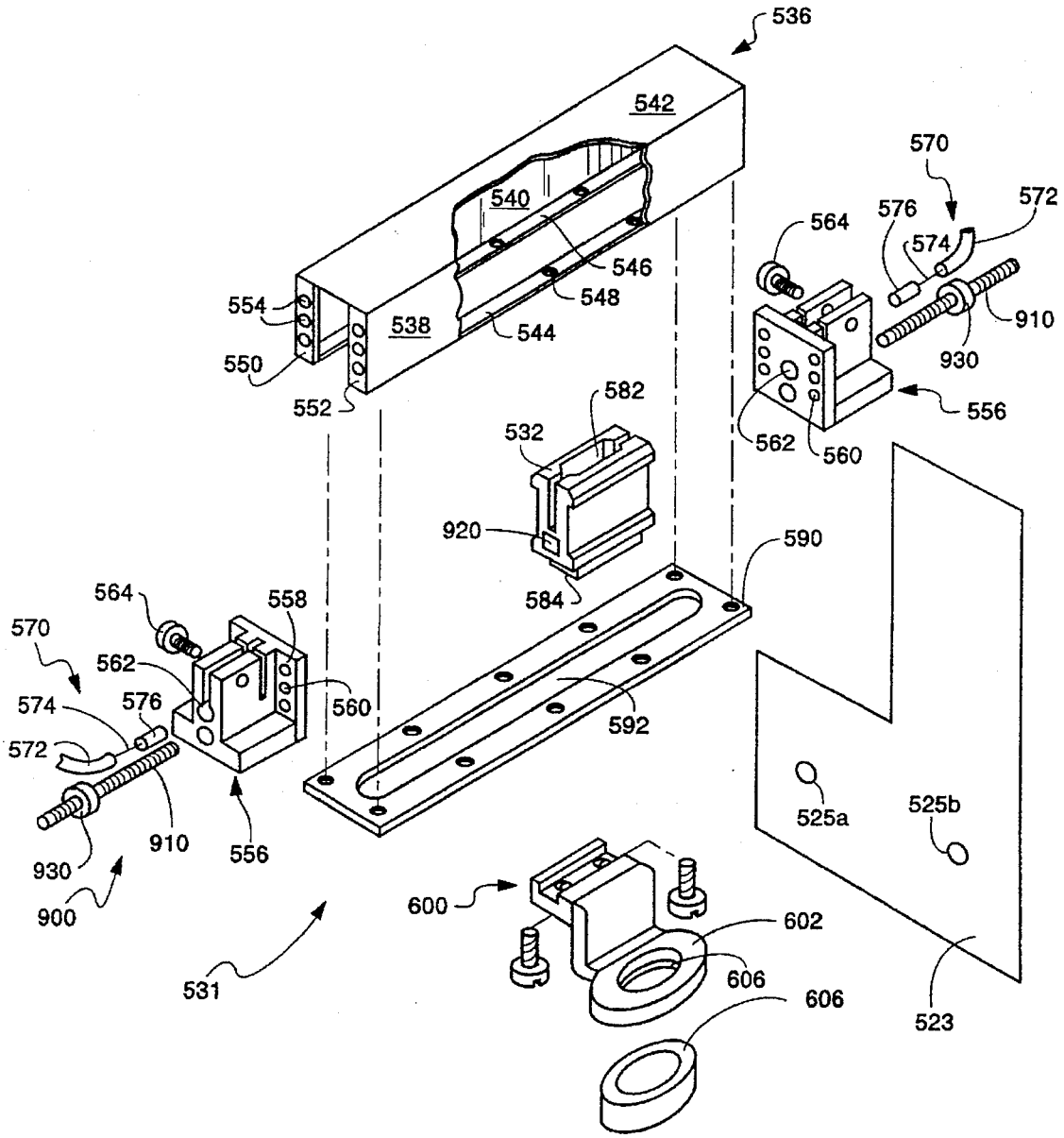
FIG. 22 is an exploded assembly view of one embodiment of a material transfer assembly.
Figure 23:
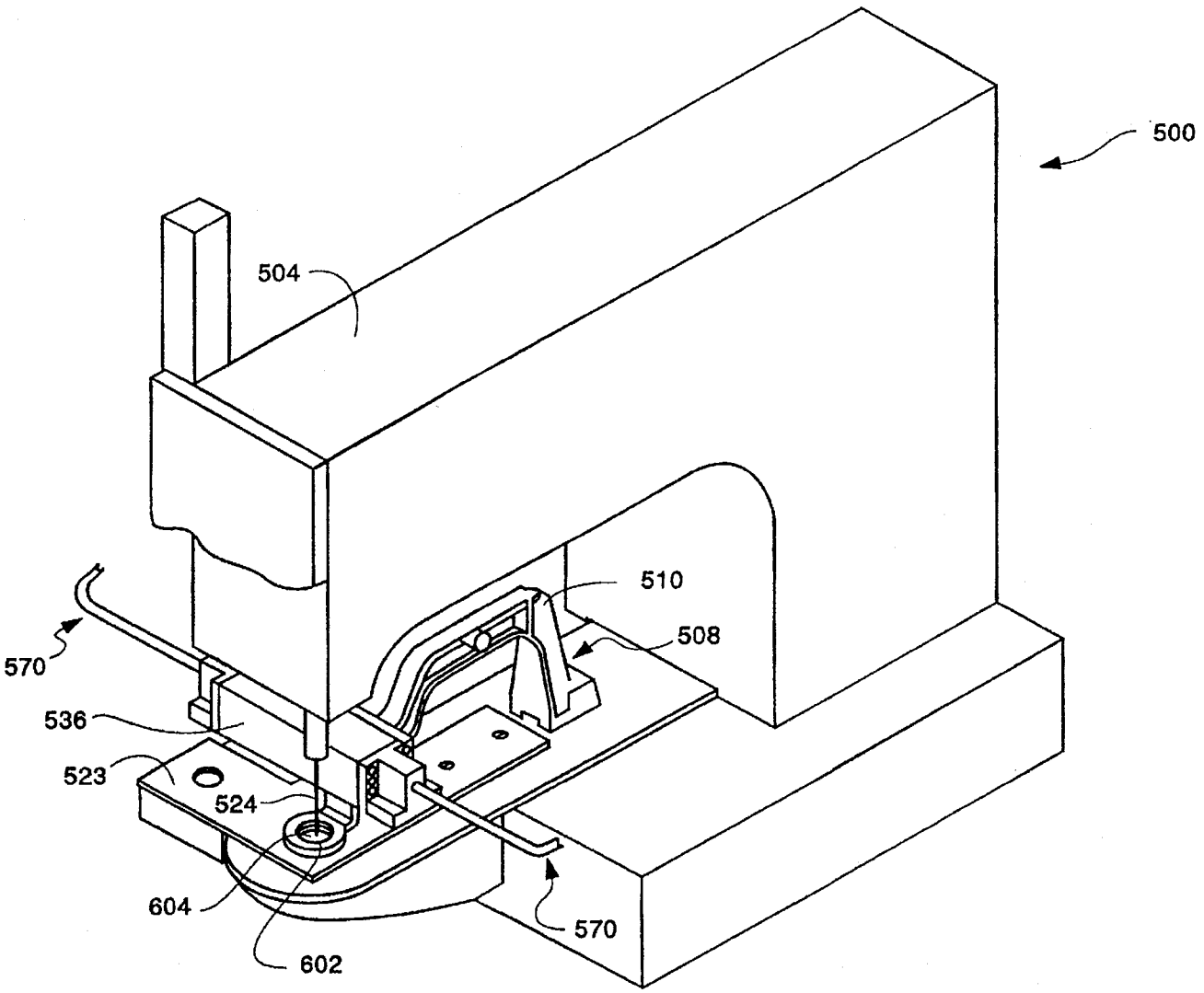
FIG. 23 is a perspective view of the cam-driven sewing machine as illustrated in FIG. 20 incorporating the material transfer assembly of FIG. 21.

Referring initially to FIGS. 22–23, a material transfer assembly 531 is illustrated therein in an exploded view and as attached to the cam-driven sewing machine 500. Generally, the material transfer assembly 531 includes a housing 536 which is fixedly attached to the arch clamp 508 such that it moves simultaneously with the arch clamp 508 during sewing operations. A transfer support member 532 is slidably and movably interconnected with the housing 536 for movement in the "x" dimension. A stitchable material clamp member 600 (e.g., structurally and functionally similar to the arch clamp foot 520) is attached to the transfer support member 532. Moreover, a bottom feed plate 523 having two laterally displaced holes **525*a*, 525*b* (one for the sewing needle 524 (525*b*) and one for the material removal device 120 (525*a*)) with a continuous and uninterrupted surface therebetween is fixedly interconnected with the arch clamp 508 in the above-noted manner (the bottom feed plate 523 thus being part of both the material transfer and sewing assemblies). The stitchable material may thus be compressively engaged between the clamp member 600 and the bottom feed plate 523 by movement of the arch clamp 508 in the "z" dimension (the arch clamp 508 moving in the "z" dimension relative to the generally stationary bottom feed plate 523). Consequently, with the stitchable material being appropriately engaged by the material clamp member 600 and the transfer support member 532, the stitchable material may be moved between at least two positions (e.g., an area generally vertically aligned with the sewing needle 524 and an area generally vertically aligned with the material removal device 120**) to affect the desired transfer of the stitchable material between the material cutting and sewing areas.

With further regard to the housing 536 and as will be discussed in more detail below, preferably the housing 536 is generally small and light so as to allow for high production speeds typically associated with cam-driven pattern tacker sewing machines and so as to not adversely affect the sewing pattern. In this regard, the housing 536 may be formed from materials such as various metals and plastics, but is preferably formed from aluminum for its combined weight reduction and strength characteristics. Moreover, the housing 536 has a length extending laterally in the "x" dimension, a width extending longitudinally in the "y" dimension, and a height extending in the "z" dimension. In one embodiment, the housing 536 measures about 6 inches in length, about ¾ inches in width, and about 1 inch in height. Moreover, the housing 536, together with the sliding block 532 and the clamp member 600, collectively weigh about 5.5 ounces. Notwithstanding these specifics, it will be appreciated that the material selection and/or sizing or weight of the housing 536 may depend upon the particular application.

The housing 536 illustrated in FIG. 22 includes a front wall 538, a back wall 540, and an upper wall 542 which all generally extend the length of the housing 536. The housing 536 further includes a front lip 544 extending rearwardly from the bottom of the front wall 538 and a back lip 546 extending frontwardly from the bottom of the back wall 540. The front lip 544 and the back lip 546 each have a plurality of threaded holes 548 for receiving fasteners for interconnecting a bottom plate 592 with the remainder of the housing 536 as will be discussed in more detail below and after the block 532 is installed. First and second end walls 550, 552, respectively, are disposed on each end of the housing 536 to define an open channel therebetween. Each end wall 550, 552 has a plurality of threaded holes 554 for receiving fasteners for interconnecting end plates 556 to the remainder of the housing 536.

The housing 536 further includes the first and second end plates 556 which are substantially identical in configuration. Each end plate 556 includes first and second side webs 558 having a plurality of holes 560 for receiving fasteners to secure the respective end plate 556 to the associated end wall 550, 552 of the housing 536. As will be appreciated, the end plates 556 may also be integrally formed with the front wall 538, back wall 540 and upper wall 542 of the housing 536 (not shown), and in this case the upper wall of the housing would have to be appropriately formed to allow for insertion of the cables 570 (discussed below) therein to affect movement of the sliding block 532 within the housing 536.

The cables 570 allow the sliding block 532 to move within the housing 536 by applying the necessary forces to the block 532. In this regard, each end plate 556 also includes a channel 562 which passes entirely through the end plate 556 for receiving a cable 570. Each cable 570 generally includes a cable housing 572, which may be secured to the associated end plate 556 using the fastening screw 564, and an interior cable 574 which is free to move relative to the cable housing 572. A cable lug 576 is secured to the end of each interior cable 574 and interconnects the interior cables 574 with the sliding block 532. The opposite ends of the interior cables 574 may therefore be interconnected with an appropriate drive assembly such as a pneumatic cylinder (not shown).

The transfer support member, or sliding block 532, is dimensioned to fit within housing 536. Once again, in order to reduce the weight of the transfer assembly 531, the block 532 may be formed from aluminum or other light-weight materials. The sliding block 532 includes a channel 582 for receiving the cable lugs 576 attached to the ends of the cables 570 to connect the interior cables 574 to the sliding block 532. The sliding block 532 further includes a key member 584 dimensioned to fit in sliding engagement within the slot 592 of the bottom plate 590 of the housing 536. After the sliding block 532 is positioned within the housing 536, as will be discussed in more detail below, the bottom plate 590 is secured to the front lip 544 and back lip 546 of housing 536 using conventional fasteners, such as screws.

The material clamp member 600 is secured to the sliding block 532 using conventional fasteners such as threaded screws or bolts. The material clamp member 600 extends generally downwardly from the sliding block 532 and includes a substantially planar support member 602 having a substantially circular aperture 604 disposed therein. A generally circular rubber grommet 606 or other "high-friction" material is secured to the bottom of the support member 602 (e.g., by being press-fit in the aperture 604) to facilitate the frictional engagement of the stitchable material by the support member 602. It will be appreciated by one of ordinary skill in the art that alternate embodiments of the material clamp member 600 may be employed depending upon the particular requirements of the application. For example, different applications may require the support member 602 to be shaped differently. Nonetheless, the support member 602 should include some type of aperture such that the sewing needle 526 and material removal device 120 may pass therethrough.

The housing 536 also includes an adjustment assembly 900 for setting/adjusting the extreme positions of the sliding block 532 within the housing 536. The adjustment assembly 900 generally includes an independently controllable adjustment screw 910 which passes completely through its associated end plate 556 and into the hollow interior of the housing 536. Consequently, each of the screws 910 function as a stop to limit the range of motion of the sliding block 532 within the housing 536. A locking nut 930 may also be included on each screw 910. In order to reduce the potential for damage to the sliding block 532 when engaging these screws 910, a steel insert 920 may be positioned on the two end faces of the sliding block 532 and the ends of the screws 910 may be rounded.

The above-described material transfer assembly 531 is particularly suited for a cam-driven pattern tacker sewing machine. Cam-driven pattern tackers typically are relatively fast moving compared with most programmables. Moreover, the speed of a cam-driven pattern tacker is not as easily controlled as a programmable. In this regard and as noted, the housing 536, sliding block 532, and material clamp member 600 in one embodiment weigh only about 5.5 ounces. Moreover, the adjustability of the extreme positions of the sliding block 532 within the housing 536 by the independently adjustable screws 910 allows for the cut or opening in the stitchable material and the sewing pattern on the stitchable material to be accurately placed. This is particularly relevant when considering cam-driven pattern tackers since it is relatively more difficult to achieve exact positionings with cams than by programming.

The material transfer assembly 531 illustrated in FIG. 22 may be assembled from the above-described components as follows. First, each of the cables 570 are connected to the associated end plate 556 by passing the cables 570 through the associated channel 562 extending through the associated end plates 556. Next, the interior cables 574 are connected to the sliding block 532 by inserting the connector lugs 576 into the receiving channel 582 in the sliding block 532. The end plates 556 may then be secured to the end walls 550, 552 of the housing 536 using convention fasteners such as threaded bolts or screws. Similarly, the bottom plate 590 may be secured to the front and back lips 544, 546 respectively, of the housing 536 using conventional fasteners such as threaded bolts or screws. Finally, the foot member 600 is secured to the sliding block, as indicated in FIG. 22, using conventional fasteners, such as threaded screws.

As noted, FIG. 23 illustrates the material transfer assembly 531 as such could be mounted on the cam-driven sewing machine 500 for moving the stitchable material laterally in the "x" dimension between the material removal area (e.g., the area generally vertically aligned with the material removal device 140) and the sewing area (e.g., the area generally vertically aligned with the sewing needle 524). Portions of the kit assembly 12 have been cut away in FIG. 23 to allow a clearer view of the material transfer assembly 531. To secure the material transfer assembly 531 to the arch clamp 508, the arch clamp foot 520 is removed and the housing 536 is connected to the front face of the arch clamp 508 using conventional fasteners, such as threaded screws, in the manner illustrated in FIG. 23. Preferably, the housing 536 is secured to the arch clamp 508 in a position that allows the aperture 604 of the material clamp member 600 to be positioned directly below the cutting head 128 of the material removal device 120 (FIG. 3) when sliding block 532 is in a first position within housing 536 (e.g., the left-most position of the block 532 in the housing 536), and is positioned directly below the sewing needle 524 when the sliding block 532 is at a second position within the housing 536 as depicted in FIG. 23 (e.g., the right-most position of the block 532 in the housing 536). The free ends of the cables 570, specifically the interior cables 574, are again connected to a conventional pneumatic cylinder assembly or other appropriate drive system (not shown) to affect lateral motion of the slide block 532 between the first and second positions within the housing 536. Moreover, the bottom feed plate 522 illustrated in FIG. 20 has again been replaced with the generally L-shaped bottom feed plate 523 illustrated in FIG. 23 to provide a smooth surface across which the stitchable material may move in the "x" dimension (e.g., the lateral extent of the bottom feed plate in the "x" dimension is at least as great as the range of motion of the sliding block 532 in the "x" dimension). Since the sliding block 532 and the clamp member 600 slide the stitchable material across the bottom feed plate 523 during transfer operations, it is desirable for the upper surface of the bottom feed plate 523 to have reduced friction characteristics. For instance, the bottom feed plate 523 may be formed from materials such as stainless steel or steel coated with a slick material to provide this function.

FIGS. 24–28 illustrate a typical material transfer cycle using the material transfer assembly 531. For ease of illustration, the front wall 538 has been removed. Although FIGS. 24–28 illustrate the assembly 531 using a continuous length of material 610, it will be appreciated that the invention is equally applicable to discrete pieces of stitchable material.

Figure 24:
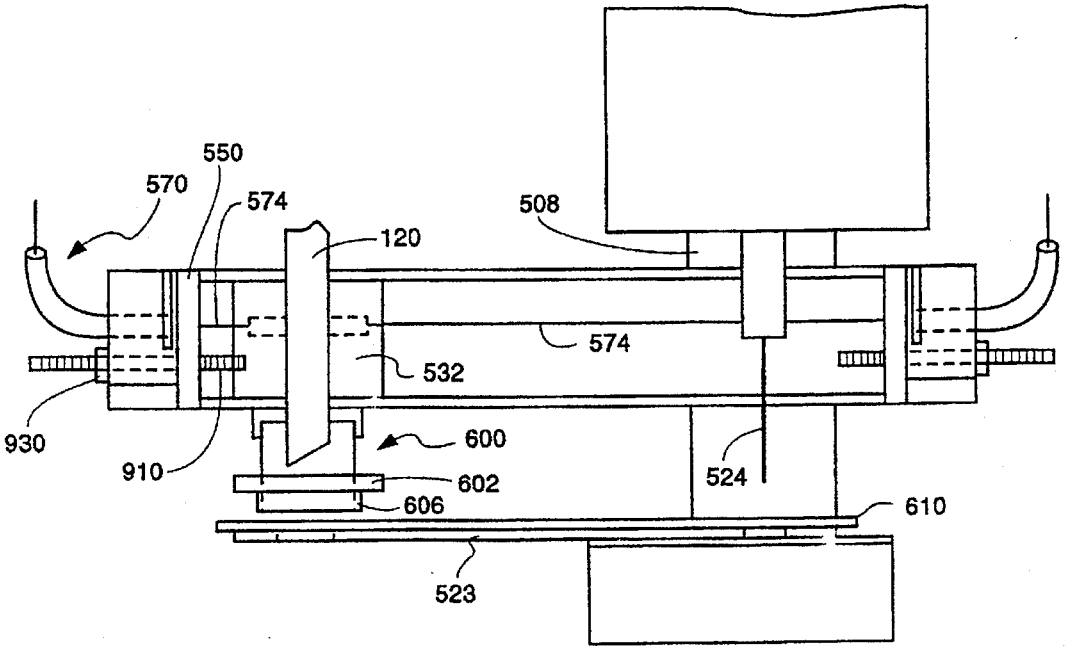
FIGS. 24–28 are front, cutaway views which illustrate the sequence of operations in a material transfer cycle.

FIG. 24 illustrates the material transfer assembly 531 at the beginning of a material transfer cycle with the arch clamp 508 in its vertically raised position. The sewing machine 500 is not in operation at this point in the cycle (i.e., no sewing operations are being performed), and the material clamp member 600 is positioned directly beneath the cutting head of the material removal device 120, but also is raised above the material 610. Moreover, the aperture 606 is vertically aligned with the material device 120 in the position established by the engagement of the left adjustment screw 910 on the sliding block 532.

Figure 25:
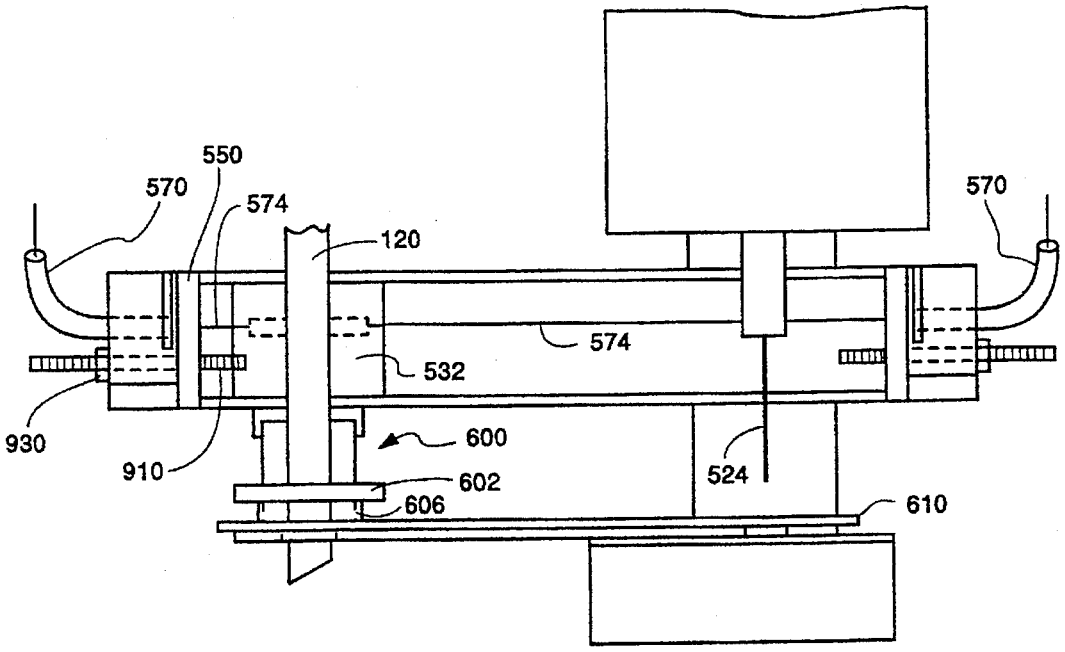

In FIG. 25, the arch clamp 508 is lowered by cams or an air cylinder (not shown) of the sewing machine 500 which causes the rubber grommet 606 of material clamp member 600 to compressively engage the material 610. At this point in the cycle, the material removal device 120 may be actuated in the manner discussed above, thereby causing the cutting head of the material removal device 120 to pass through the material 610 to cut a hole or other type of opening in the material 610.

Figure 26:
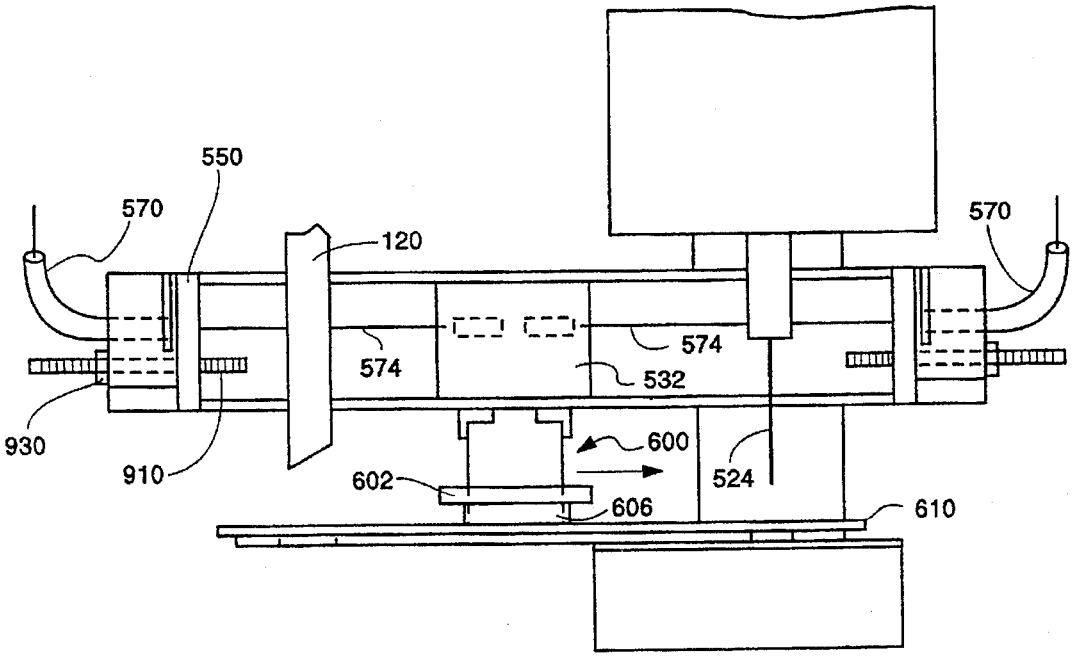
Figure 27:
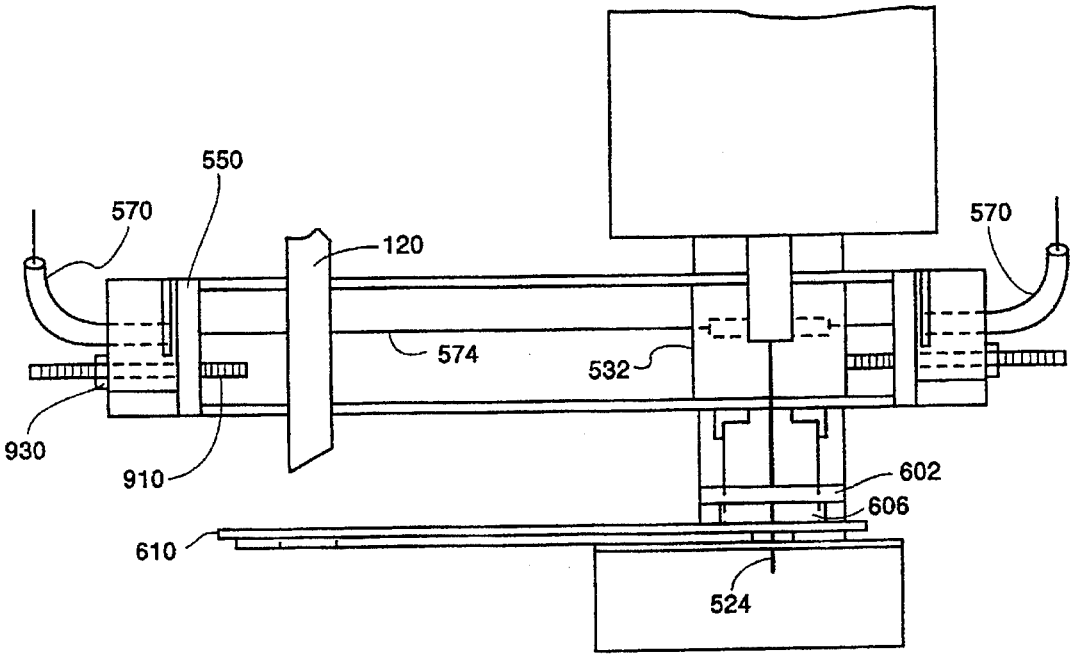

After the cutting head 128 retracts from the material, the pneumatic cylinder or other drive mechanism for the material transfer assembly 531 is actuated to cause the sliding block 532, and therefore the compressively engaged material 610, to move toward the sewing needle 524, as illustrated in FIG. 26. That is, the right interior cable 574 is retracted by the noted drive assembly and the left interior cable 574 "lengthens" or extends. During the movement, the sliding block 532 and the clamp member 610 slide the material 610 over the stationary bottom feed plate 523 while in compressive engagement therewith. In this regard, the smooth, continuous uninterrupted upper surface of the bottom feed plate 523 facilitates this movement in the required accuracies, together with its reduced friction surface. When the sliding block 532 reaches the extreme right end of its range of travel as established by the right adjustment screw 910, the aperture 604 in the material clamp member 600 is positioned directly beneath the sewing needle 524, as illustrated in FIG. 27. At this point in the cycle sewing operations may take place by moving the arch clamp 508 and the bottom feed plate 523 relative to the vertically reciprocating needle 524, as discussed above. Generally, the sliding block 532 is maintained in a fixed position relative to the arch clamp 508 and the housing 536 during sewing operations. This may be accomplished by maintaining a proper tension on at least one of the interior cables 574. In the disclosed embodiment, it is intended that sewing operations occur substantially entirely within the circular aperture 606 in the material clamp member 600.

Figure 28:
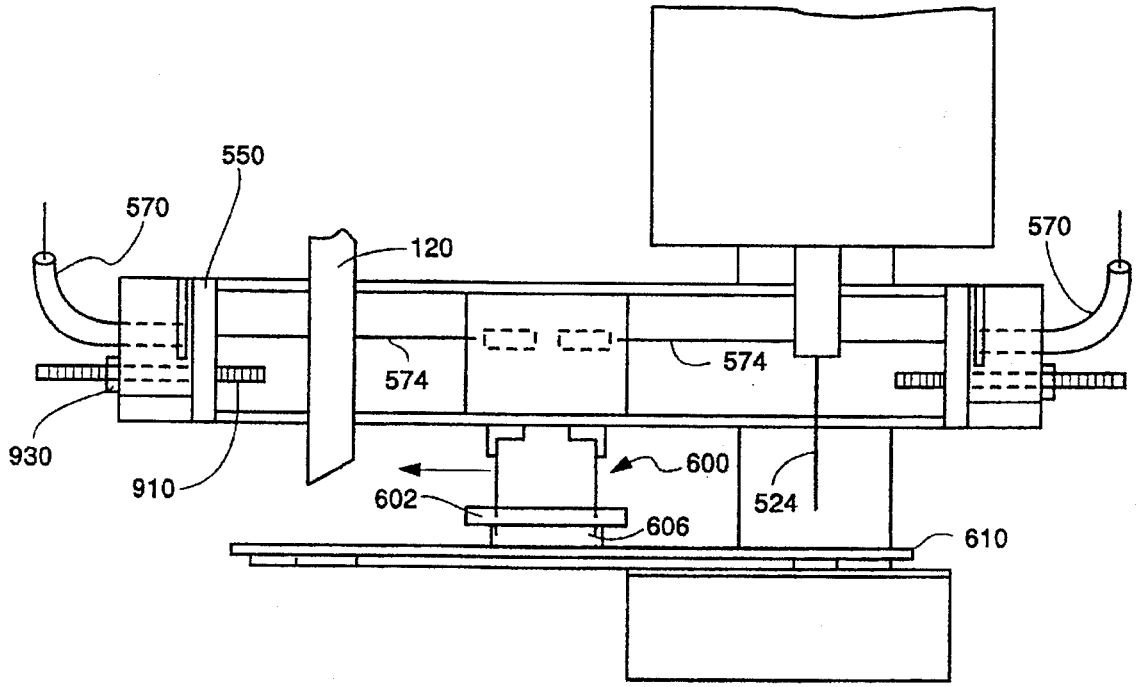

After sewing operations are completed the arch clamp 508 moves upwardly to release the material 610 from the compressive engagement provided by the clamp member 600 and the bottom feed plate 523, and the pneumatic cylinder driving for the material transfer assembly 531 is actuated to return the sliding block 532 toward the left end of the housing 536 as illustrated in FIG. 28 and as established by the left adjustment screw 910. That is, the block 532 is positioned opposite the sewing needle 524 to position the aperture 606 in the material clamp member 600 directly beneath the cutting head 128 of the material removal device 120 as illustrated in FIG. 24 discussed above. At this point the material transfer cycle may be repeated if desired.

Although the material transfer assembly 531 has been described in relation to using the kit assembly 12 in combination with the cam-driven sewing machine 500, it will be appreciated that the transfer assembly 531 would be equally applicable to a cam-driven pattern tacker machine which integrally included material removal structure with the sewing structure. Moreover, as in the above case, sewing operations may be performed before material cutting operations. That is, the slide block 532 would initially be positioned in the sewing area and sewing operations would be performed with the material 610 being engaged between the clamp member 600 and the bottom feed plate 532. Thereafter, the slide block 532 would move the stitchable material 610 over to the material cutting area by sliding the material 610 over the feed plate 523 while exerting a compressive force thereon. Finally, the material removal device 120 would pass through the material 610.

Figure 19:
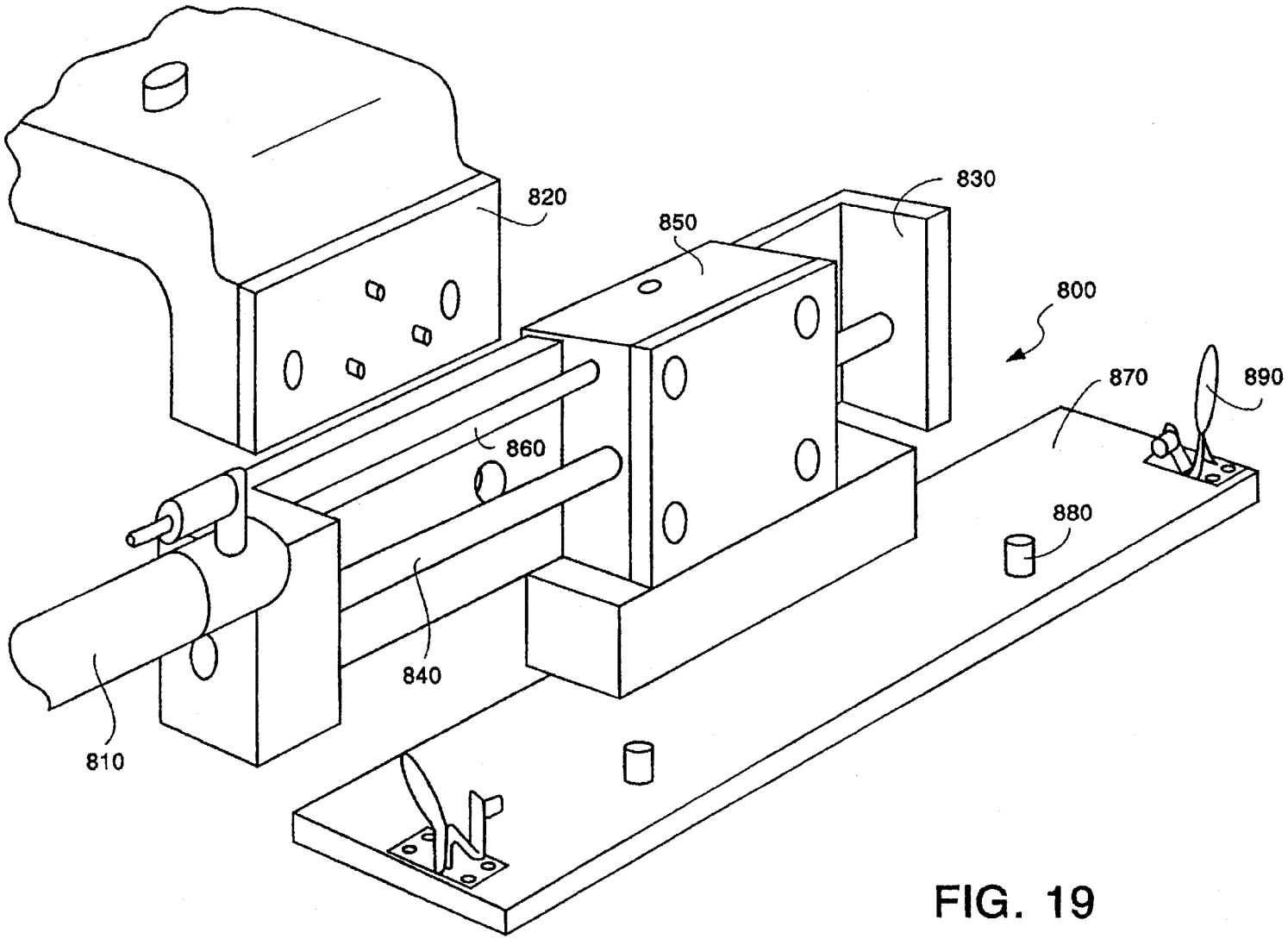
FIG. 19 PRIOR ART
FIG. 19 is a prior art expansion kit for a programmable sewing machine.

A prior art expansion kit for a programmable sewing machine manufactured and sold by the assignee of this patent application is illustrated in FIG. 19. Generally, the expansion kit 800 of FIG. 19 includes a double acting pneumatic cylinder 810 which is mounted on the arch clamp 820 of a programmable sewing machine (e.g., generally similar to the machine 16 of FIG. 1) by a shift clamp housing 830. The cylinder 810 has about a 6-inch stroke via an extendable and retractable rod 860, and the programmable machine for which the expansion kit 800 was designed has the ability to sew a pattern of about 6 inches in the "x" dimension.

The rod 860 of the cylinder 810, which is interconnected with the movable, double acting piston (not shown) therein, is fixedly connected to a shift support block 850. A stabilizing rod 840 extends between the ends of the shift clamp housing 830 for supporting the shift block support 850. A work plate 870 is fixedly attached to the lower portion of the shift block support 850. A pallet clamp (not shown) may be attached to the work plate 870 by the pins 880 and pressure clamps 890. Generally, the pallet clamp retains the material to be sewn and has an opening such that the sewing needle can produce the selected sewing pattern. Consequently, once the material to be sewn is properly positioned within the pallet clamp and such is installed on the work plate 870 in the noted manner, the arch clamp 820 will move in the "x" and "y" dimensions to sew one-half of the sewing pattern on the material with the shift support block 850 being in its first position, for instance, an extreme right position as shown in FIG. 19. Thereafter, the piston of the cylinder 810 is shifted to its second position to move the shift support block 850 to its second position, for instance to the left of where it is positioned in FIG. 19, such that the other half of the sewing pattern may be produced in the noted manner. Consequently, the expansion kit 800 allows for patterns to be sewn which are up to twice the size in the "x" dimension of the "x" dimension capabilities of the programmable sewing machine.

Figure 29:
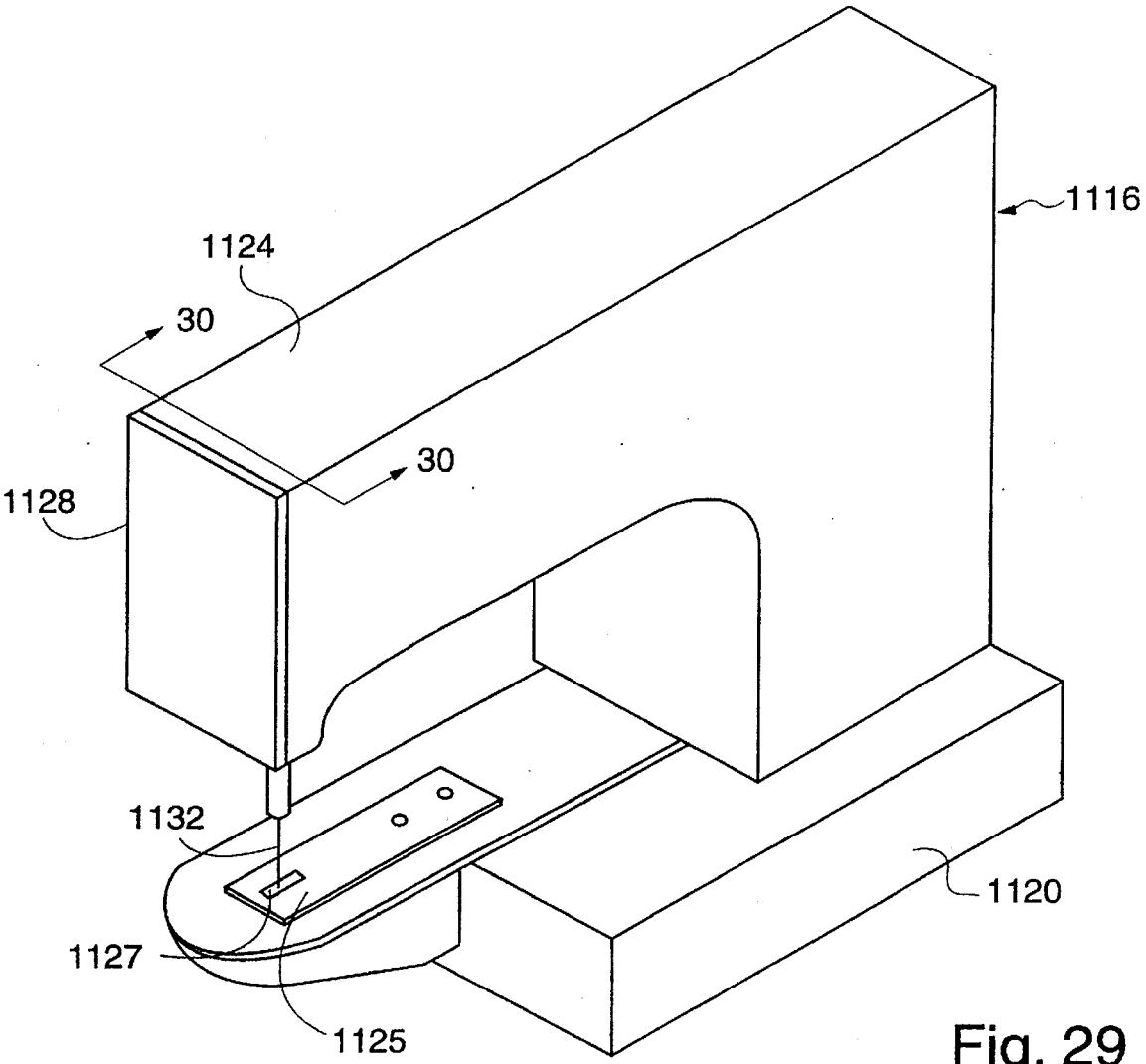
FIG. 29 is a perspective view of a known cam cycled sewing machine.
Figure 30:
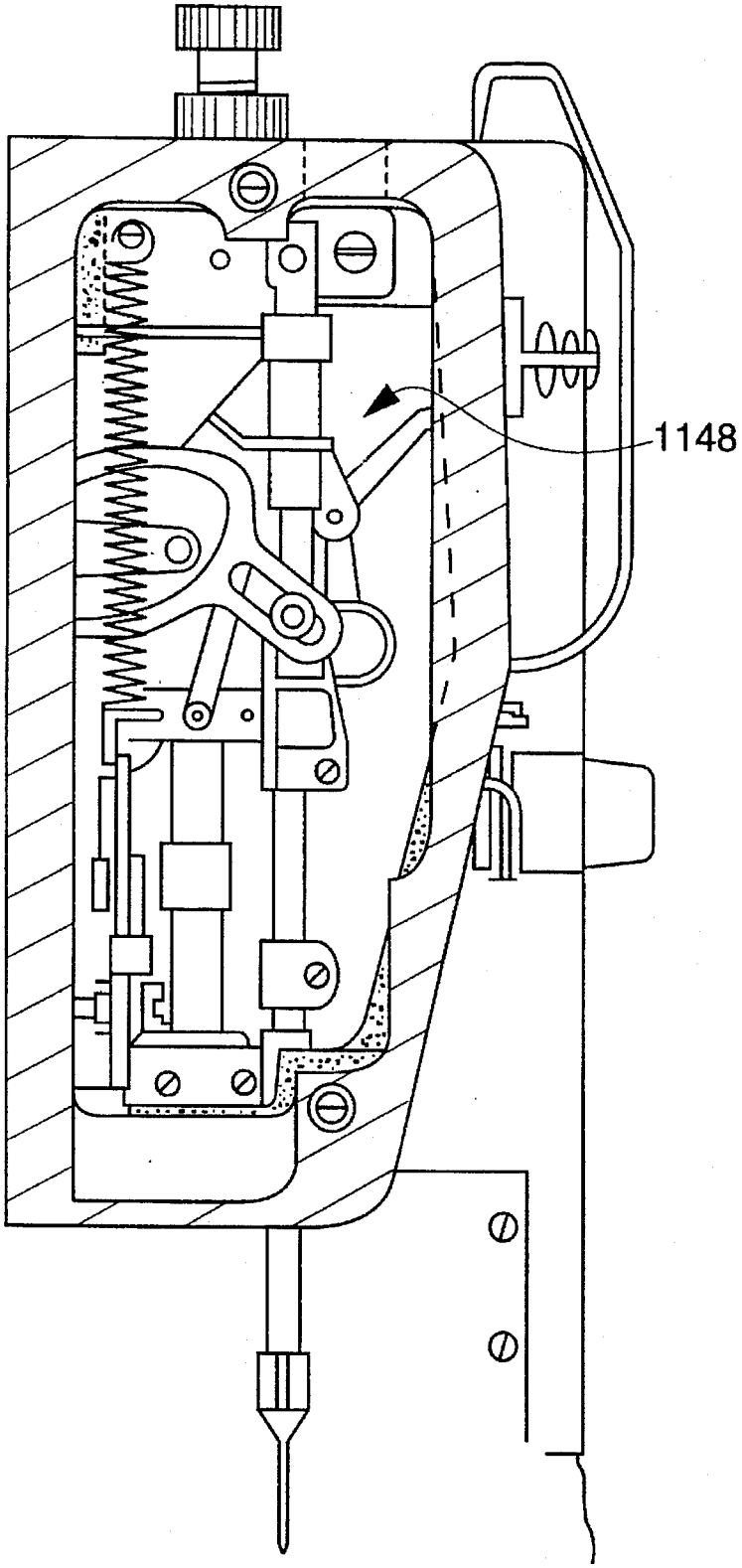
FIG. 30 is a cross-sectional view of the sewing needle drive assembly of FIG. 29 taken along line 30—30.

Another attachment for sewing machines described below generally relates to providing jump foot capabilities for machines which were not originally configured to provide this feature. These types of machines may include cam cycled and small electric sewing machines. The general structure of a cam cycled machine is illustrated in FIGS. 29–30. The sewing machine 116 generally includes a base 1120 and a head 1124 which is vertically displaced above the base 1120. The base 1120 and head 1124 are typically formed by a casting for industrial applications of the machine 1116. The base 1120 supports the machine 1116 and also the material to be sewn upon or the stitchable material. Specifically, the stitchable material is supported on a throat plate 1125 which has a needle hole 1127 extending therethrough. The sewing needle 1132, which is vertically reciprocated by a sewing needle drive assembly 1148 contained within the head 1124 and which includes a vertically reciprocating needle bar to which the sewing needle is attached, may thus penetrate through the stitchable material and pass through the needle hole 1127 such that the sewing needle 1132 may interact with other sewing components contained within the base 1120 and below the throat plate 1125 to form the desired stitch.

Figure 31:
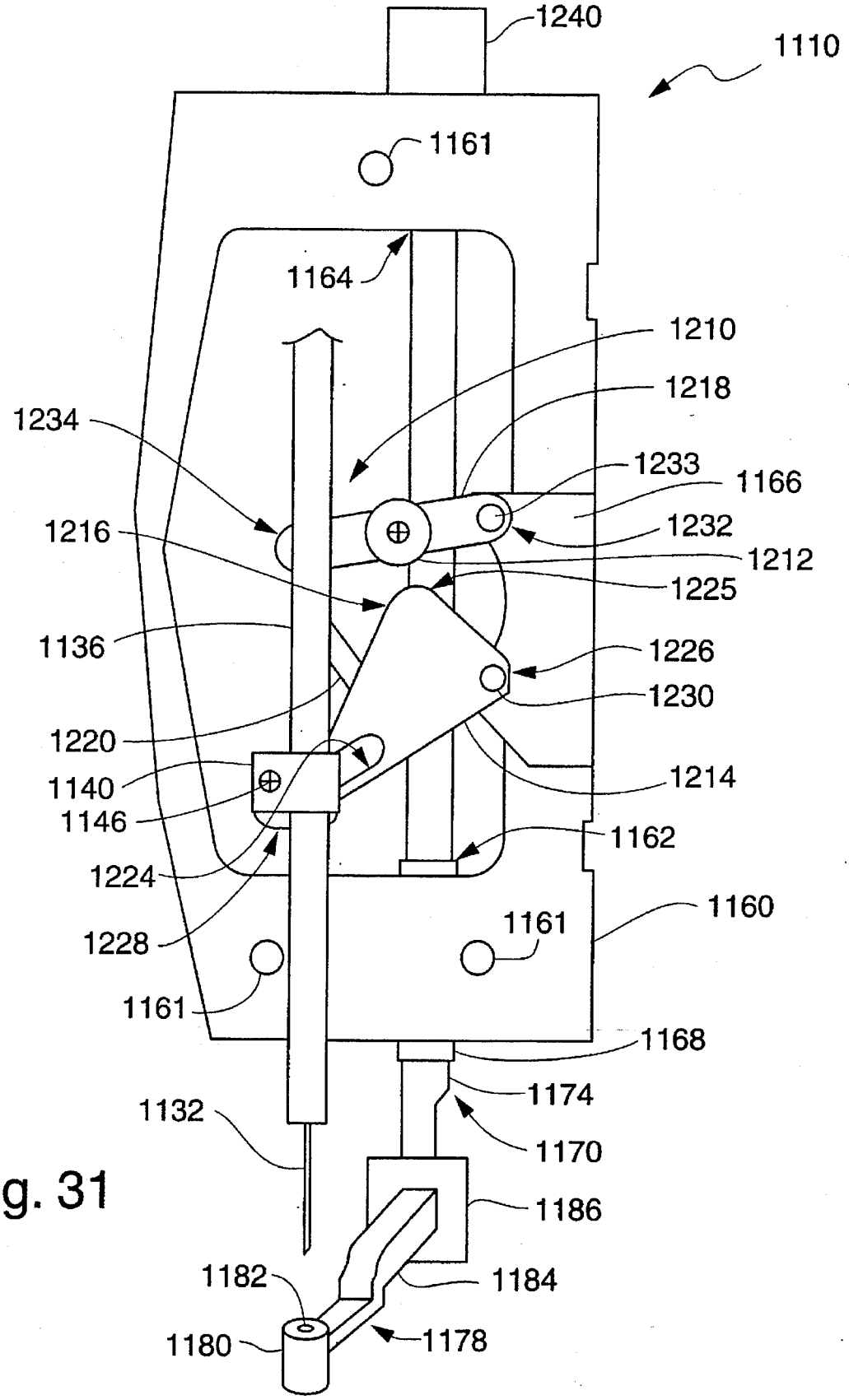
FIG. 31 is a back view of the jump foot kit assembly interconnected with the needle bar of the sewing machine.
Figure 32:
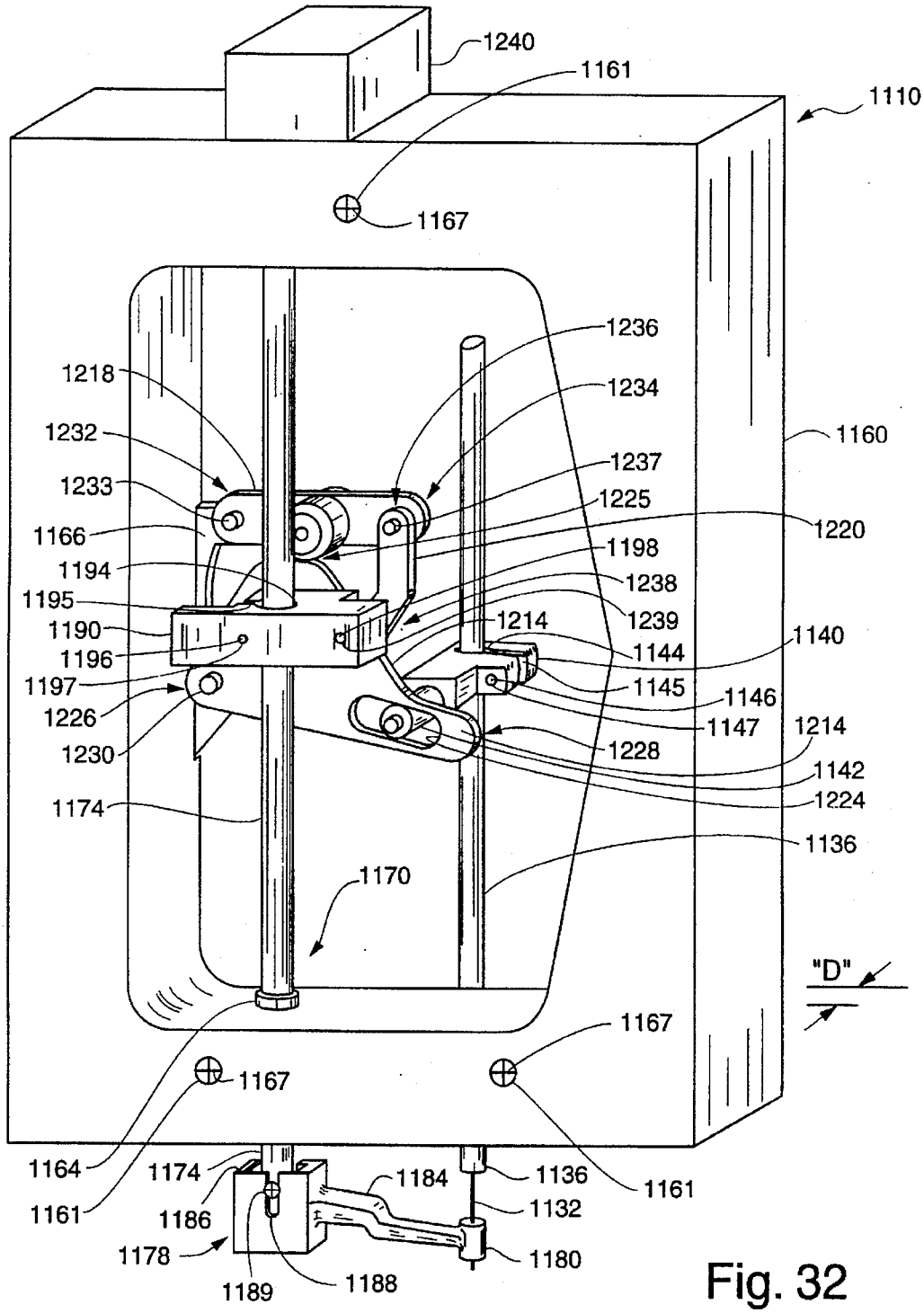
FIG. 32 is a front perspective view of the jump foot kit assembly interconnected with the needle bar of the sewing machine.

One embodiment of the jump foot kit assembly 1110 which may be installed on the sewing machine 1116 is illustrated in FIGS. 31–32 as it would be typically integrated with the sewing machine 1116 of FIGS. 29–30. The jump foot kit assembly 1110 includes a housing 1160 which is detachably connectable to the end of the head 1124 of the sewing machine 1116. This is affected by removing the head cover 1128 and installing the housing 1160 onto the head 1124 with suitable fasteners as will be discussed below. The jump foot kit 1110 also generally includes a jump foot assembly 1170 which includes a vertically reciprocable jump foot driver or bar 1174 with a jump foot 1178 attached thereto. The jump foot assembly 1170 is operatively associated with the housing 1160 and a linkage assembly 1210 operatively interconnects the jump foot assembly 1170 with the sewing needle drive assembly 1148. The motion of the sewing needle drive assembly 1148, again provided with the machine 1116 by the manufacturer, is thus utilized to operate the jump foot assembly 1170 in a manner which reduces the potential for flagging of the stitchable material.

As illustrated in FIGS. 31–32, the housing 1160 contains portions of the jump foot assembly 1170 and the linkage assembly 1210. In order to accommodate the vertically reciprocable jump foot bar 1174, the housing 1160 comprises upper and lower bores 1162, 1164, respectively. For purposes of reducing friction and wear on the jump foot bar 1174 and the housing 1160, the lower bore 1164 includes an annular bushing 1168 positionable therein which is thus positioned between the housing 1160 and the jump foot bar 1174. In this regard, the lower bore 1164 is sized to accommodate the diameter or width of the jump foot bar 1174 and the outer diameter of the annular bushing 1168. The upper bore 1162 of the housing 1160 is sized to receive an upper portion of the jump foot bar 1174. The upper bore 1162 may also include an annular bushing to facilitate the interface between the housing 1160 and the jump foot bar 1174. In addition, the upper bore may extend through the housing 1160 to the top surface of the housing 1160 to operatively connect the jump foot bar 1174 with an actuating means 1240 described below.

In order to detachably secure the jump kit assembly 1110 to the head 1124 of the sewing machine 1116, the housing 1160 includes a number of bores 1161 which correspond in position to bores (not shown) in the head 1124 of the sewing machine or more specifically its casting. In this regard, the jump foot kit assembly 1110 may be detachably secured to the sewing machine 1116 by inserting a corresponding number of securing members 1167 through the bores 1161 of the housing 1160 and into the bores of the head 1124 of the sewing machine 1116. The jump kit assembly 1110 may be disengaged from the head 1124 of the sewing machine 1116 by removing the securing members 1167. In one embodiment of the present invention, the securing members 1167 are elongated and threaded to facilitate engagement and disengagement (i.e., attachment and detachment) of the jump kit assembly 1110 with and from the head 1124 of the sewing machine 1116. In a preferred embodiment, the securing members 1167 comprise screws. The bores 1161 may be correspondingly threaded to receive the threaded securing members 1167.

The jump foot assembly 1170 generally includes a jump foot bar 1174 and a jump foot 1178 connected to a lower end of the jump foot bar 1174 as noted above. Since the jump foot assembly 1170 is in the form of a kit, the jump foot bar 1174 and the needle bar 1136 are offset, along a line parallel to the head 1124, by a distance "D" of at least about ¼ inch, sometimes at least ½ inch, and sometimes even at least 1 inch depending upon the configuration of the sewing machine on which the kit assembly 1110 is attached (i.e., the jump foot bar 1174 is displaced outwardly from the needle bar 1136). The jump foot bar 1174 comprises an elongated member with upper and lower ends, the lower end receiving the jump foot 1178. The jump foot 1178 may be fastened to the lower end of the jump foot bar 1174 by any suitable mechanical fasteners, such as screws, snaps, pins, rivets or clamps, or by any suitable chemical means, such as glue, or by welding or soldering. Substantially all of the jump foot bar 1174 is positioned and contained within the interior of the housing 1160. However, during sewing operations, at least the lower end of the jump foot bar 1174 extends outside (specifically below) of the housing 1160 as the jump foot bar 1174 and jump foot 1178 reciprocate in a manner described hereinbelow. Furthermore, in order for the jump foot 1178 to be positionable about the sewing needle 1132 during sewing and anti-flagging operations, the jump foot 1178 is located outside of the housing 1160. In this regard, the jump foot bar 1174 extends from an interior area of the housing 1160 through a bore 1162 in the lower portion of the housing 1160. Consequently, even as the jump foot assembly 1170 vertically reciprocates relative to the housing 1160, the lower end of the jump foot bar 1174 and therefore the jump foot 1178 remain outside of the housing 1160 with the jump foot 1178 being positionable about the sewing needle 1132. Therefore, the jump foot bar 1174 should be of a length sufficient to allow vertical reciprocation of the jump foot 1178 such that the jump foot 1178 does not strike the lower exterior surface of the housing 1160 during sewing and anti-flagging operations.

In one embodiment, an actuating means 1240 interfaces with the upper end of the jump foot bar 1174 to "preload" the jump foot bar 1174. A constant force between about 5 psi and about 30 psi may be applied to the upper end of the jump foot bar 1174 in order to operatively connect or associate the jump foot assembly 1170 with the needle bar 1136 via the linkage assembly 1210 during sewing and anti-flagging operations. In particular, the actuating means 1240 may apply a constant downwardly oriented force on the jump foot bar 1174 such that a roller 1212 of the linkage assembly 1240 constantly contacts an upper surface 1216 of a cam 1214 of the linkage assembly 1240, especially during sewing and anti-flagging operations. By constantly engaging the roller 1212 on the upper surface 1216 of the cam 1214, the jump foot bar 1174 is thus capable of moving, in a delayed or lagging fashion, with the needle bar 1136 as the needle bar 1136 is driven vertically reciprocally. As can be appreciated, other orientations of the roller 1212 relative to the cam 1214 could be utilized such that the roller 1212 would engage the cam 1214 in a different manner.

Conversely, an oppositely oriented preloading force may be applied to the jump foot assembly 1170 by the actuating means 1240 in order to disengage the operative connection between the needle bar 1136 and the jump foot bar 1174. In this regard, the actuating means 1240 may apply a substantially constant force on the jump foot bar 1174 or jump foot 1178 to move the jump foot bar 1174 upwardly, thereby disengaging and displacing the roller 1212 from the upper surface 1216 of the cam 1214 such that during sewing operations without anti-flagging operations, the needle bar 1136 is not operatively connected to the jump foot bar assembly 1170. Consequently, the actuating means 1240 may apply an upward force to disengage the anti-flagging operation of the sewing machine during stitching operations. In order to preload the jump foot bar assembly 1170 such that sewing operations can be accomplished without anti-flagging operations, the actuating means 1240 may apply a force to the jump foot bar 1174 between about 5 psi and about 30 psi.

To provide sufficient downward preloading of the jump foot bar 1174 and to therefore keep the roller 1212 in constant contact with the upper surface 1216 of the cam 1214 during sewing operations, the actuating means 1240 may be selected from the group consisting of air cylinders, springs, electric motors, weights and the like. In a one embodiment, however, the actuating means 1240 is preferably an air cylinder as an air cylinder is capable of selectively providing both upwardly and downwardly oriented forces on the jump foot assembly 1170. In one embodiment, the actuating means 1240 is mounted on the exterior upper surface of the housing 1160 and is operatively connected to the jump foot assembly 1170 and more specifically, the jump foot bar 1174, through the bore 1164 in the upper portion of the housing 1160.

The jump or jump foot 1178 is fastened to the lower end portion of the jump foot bar 1174 and extends below and relative to the lower exterior surface of the housing 1160 as noted. In one embodiment, the jump foot 1178 includes a leg 1184 extending between the end portion 1180 and the body portion 1186 of the jump foot 1178. The jump foot 1178 may be fastened to the jump foot bar 1174 by inserting the lower end portion of the jump foot bar 1174 into a slot 1188 in the body portion 1186 of the jump foot 1178, and securing the lower end of the jump foot bar 1174 within the slot 1188 by inserting an elongated member 1189, such as a screw, against the lower end of the jump foot bar 1174 to frictionally engage the jump foot bar 1174, or alternatively, through a bore in the lower end of the jump foot bar 1174.

In order to inhibit flagging of the stitchable material during sewing operations, the end portion 1180 of the jump foot 1178 is positionable about the sewing needle 1132 and engageable with the stitchable material. In one embodiment, shown in FIGS. 31–32, the sewing needle 1132 is receivable within the end portion 1180 of the jump foot 1178, which includes an aperture or bore 1182 extending along a centrally located longitudinal axis from a top surface of the end portion 1180 to a bottom surface of the end portion 1180. Since the sewing needle 1132 is vertically reciprocable within and relative to the end portion 1180 of the jump foot 1178, the diameter of the bore 1182 is greater than the outer diameter of the sewing needle 1132. In addition, the diameter of the bore 1182 should be large enough to accommodate sewing thread, which extends about the sewing needle 1132.

In order to be positionable about the sewing needle 1132, the leg 1184 of the jump foot 1178 is elongated and extends between the body portion 1186 and the end portion 1180. Furthermore, since the kit assembly 1110 is attachable to the head 1124 of the sewing machine 1116, the sewing needle 1132 is displaced from the body portion 1186 of the jump foot 1178. In this regard, the leg 1184 of the jump foot 1178 should be of a length sufficient to extend from the body portion 1186 of the jump foot 1178 to the sewing needle 1132 such that the sewing needle 1132 is receivable and vertically reciprocable within the bore 1182 of the jump foot 1178.

As illustrated in FIGS. 31 and 32, the linkage assembly 1210 extends between the needle bar 1136 and the jump foot assembly 1170. The linkage assembly 1210 primarily functions to operatively interconnect the vertically reciprocable needle bar 1136 with the jump foot assembly 1170 to vertically reciprocally drive the jump foot bar 1174 and jump foot 1178 substantially with the needle bar 1136, in a time-delayed or lagging manner. In this regard, as the sewing needle 1132 moves from its bottom dead center position towards a top dead center position, the sewing needle 1132 moves upwardly relative to the jump foot 1178 as the jump foot 1178, at least initially, stays engaged with the stitchable material to inhibit flagging. The linkage assembly 1210 generally comprises a cam 1214 slidably mounted at one end to the needle bar 1136 and pivotally interconnected to the housing 1160 at a second end, a first linkage 1218 pivotally connected at one end to the housing 1160 and having a roller 1212 rollably engageable with the cam 1214, and a second link 1220 pivotally connected to and extending between a second end of the first linkage 1218 and the jump foot bar 1174. Consequently, when the actuating means 1240 moves the jump foot assembly 1170 downwardly such that the roller 1212 engages the upper surface 1216 of the cam 1214, the anti-flagging operation for the sewing machine 1116 is activated. More specifically, when the roller 1212 is in constant contact with the upper surface 1216 of the cam 1214, the jump foot bar 1174 is driven vertically reciprocally as a result of the operative interconnections between the needle bar 1136 with the cam 1214, the cam 1214 with the roller 1212, which is rotatably mounted on the first linkage 1218, and the second link 1220 extending between the first linkage 1218 and the jump foot bar 1174.

In one embodiment, a first end 1226 of the cam 1214 is pivotally connected to a bracket 1166 secured to the housing 1160 and a second end 1228 of the cam 1214 is slidably interconnected with an end portion 1142 of a needle bar clamp 1140 (described in more detail hereinbelow) which is fastened or clamped to the needle bar 1136. The end portion 1142 of the needle bar clamp 1140 should be sized so as to be slidably engaged within a slot 1224 of the cam 1214 such that the end portion 1142 is moveable within the slot 1224 as the needle bar 1136 reciprocates. Such interconnections allow the cam 1214 to move about the first end 1226 of the cam 1214 connected to the bracket 1166 as the needle bar 1136 vertically reciprocates, such that the second end 1228 of the cam 1214 moves along an arcuate pathway. The first end 1226 of the cam 1214 may be pivotally connected to the bracket 1166 by a securing means 1230 selected from the group consisting of screws, bolts, pins and rivets. In addition, the length of the slot 1224 should be sized to allow a desired stroke or reciprocation length for the jump foot 1178 (i.e., the distance between the top and bottom dead center positions of the jump foot 1178). Furthermore, the width of the slot 1224 is dependent upon the diameter of the end portion 1142. That is, the width of the slot 1224 should be slightly larger than the diameter of the end portion 1142 of the needle bar clamp 1136 so as to allow slidable movement of the end portion 1142 within the slot 1224.

In order to vertically reciprocate the jump foot 1178, the cam 1214 is operatively connected to the jump foot 1178 via the roller 1212, which is rotatably mounted on the first linkage 1218, and the second link 1220, which extends between the first linkage 1218 and the jump foot bar 1174. The first linkage 1218 includes first and second ends 1232, 1234 and a roller 1212 rotatably mounted on the first linkage 1218 between the first and second ends 1232, 1234. In one embodiment, the first end 1232 may be pivotally connected to the bracket 1166 by a securing member 1233 selected from the group consisting of screws, bolts, pins and rivets. The second end 1234 of the first linkage 1218 may be pivotally interconnected to the upper end 1236 of the second link 1220 by a securing means 1237 selected from the group consisting of screws, bolts, pins and rivets. The roller 1212 may be mounted to the first linkage 1218 such that the roller 1212 is rotatable about its axis. In this regard, the roller 1212 may rollably engage the upper surface 1216 of the cam 1214 as the cam 1214 moves arcuately about its first end 1226. For example, as the needle bar 1136 moves upwardly and moves the second end 1228 of the cam 1214 upwardly along an arcuate path, the roller 1212 rolls along the upper surface 1216 of the cam 1214 toward the upper portion 1225 of the cam 1214. This in turn causes the second end 1234 of the first linkage 1218 to move upwardly along an arcuate path, about the first end 1232 of the first linkage 1218, which causes the second link 1220 to move upwardly therewith.

The second link 1220 generally comprises an elongated member having upper and lower ends 1236, 1238. The second link 1220 maybe straight, angled or curved. In one embodiment, illustrated in FIG. 32, the upper end 1236 is disposed at an obtuse angle relative to the lower end 1238 of the second link 1220. Substantially as described above, the upper end 1236 of the second link 1220 is rotatably or pivotally connected to the second end 1234 of the first linkage 1218. The lower end 1238 of the second link 1220 is pivotally connected to a jump foot bar clamp 1190 (described in more detail hereinbelow) which is secured to the jump foot bar 1174 via a securing member 1196 selected from the group consisting of screws, bolts, pins and rivets. Consequently, it will be appreciated that as the second link 1218 is moved upwardly or downwardly with the second end 1234 of the first linkage 1218, the jump foot bar 1174 and the jump foot 1178 move upwardly or downwardly, substantially depending upon whether the needle bar 1136 is moving upwardly or downwardly.

As noted above, the needle bar clamp 1140 and the jump foot bar clamp 1176 are secured to the needle bar 1136 and jump foot bar 1174, respectively. The clamps 1140, 1176 may be mechanically or chemically secured to the needle bar 1136 and the jump foot bar 1174, respectively. In one embodiment of the present invention, the needle bar clamp 1140 comprises an end portion 1142 which slidably interfaces with the slot 1224 of the cam, a circular bore 1144, a gap 1145 and an aperture 1147 extending through the gap 1145, perpendicular thereto. The end portion 1142 of the needle bar clamp 1140 may protrude and extend from a surface of the needle bar clamp 1140 such that it may be received within the slot 1224 of the cam 1214. The circular bore 1144 and the gap 1145 each extend from an upper surface to a lower surface of the needle bar clamp 1140. The circular bore 1144 may be sized to receive the needle bar 1136 therein. In this regard, the circular bore 1144 may have a diameter equal to or less than the outer diameter of the needle bar 1136. Once the needle bar 1136 is positioned within the circular bore 1144, a securing member 1146 may be inserted into the aperture 1147 to clamp or "pinch" the needle bar 1136 within the circular bore 1144 by substantially closing the gap 1145 by drawing opposing portions (i.e., portions separated by the gap 1145) of the needle bar clamp 1140 towards one another. In one embodiment, the securing member 1146 is an elongated threaded member, such as a screw. The aperture 1147 may be correspondingly threaded to receive the threaded securing member 1146.

Similarly, the jump foot bar clamp 1190 generally comprises a circular bore 1194, a gap 1195 and a first aperture 1197 extending through the gap 1195, perpendicular thereto. The jump foot bar clamp 1190 also includes a second aperture 1198 which receives a securing member 1239 to pivotally connect the lower end 1238 of the second link 1220 to the jump foot bar clamp 1190. Substantially as described with regard to the needle bar clamp 1140, the circular bore 1194 and gap 1195 longitudinally extend from the upper surface of the jump foot bar clamp 1190 to the lower surface thereof. The circular bore 1194 may be sized to receive the jump foot bar 1174. In this regard, the circular bore 1194 has a diameter less than or equal to the outer diameter or width of the jump foot bar 1174. Once positioned within the circular bore 1194, a securing member 1196 may be inserted through the first aperture 1197 such that the jump foot bar 1174 is pinched or clamped therein by substantially drawing opposing portions (i.e., portions separated by the gap 1195) of the jump foot bar clamp 1190 toward one another. In one embodiment, the securing member 1196 comprises an elongated threaded member, such as a screw. The first aperture 1197 may be correspondingly threaded to receive the threaded securing member 1196.

Based upon the foregoing, it will be appreciated that the jump foot kit assembly 1110 is particularly suited for providing jump foot capabilities to sewing machines which were not originally configured by the manufacturer to have jump foot capabilities. As such, since the jump foot kit assembly 1110 is a kit, it allows a user to upgrade an often less expensive machine to perform similarly to an often higher priced model.

The foregoing description of the invention has been presented for purposes of illustration and description. Further, the description is not intended to limit the invention to the form disclosed herein. Consequently, variations and modifications commensurate with the above teachings, in the skill or knowledge of the art, are within the scope of the present invention. The embodiments described hereinabove are further intended to explain best modes known of practicing the invention and to enable others skilled in the art to utilize the invention in such, or other, embodiments and with the various modifications required by their particular applications or uses of the invention. It is intended that the appended claims be construed to include alternative embodiments to the extent permitted by the prior art.

What is claimed is:

1. An apparatus attachable to a sewing machine for engaging stitchable material on which the sewing machine performs sewing operations, the sewing machine having a head and a sewing needle assembly comprising a sewing needle supported by a needle bar, the head containing components for driving the sewing needle assembly, the needle bar being slidably interconnected with and at least partially disposed within the head, and further being reciprocable relative to the head said apparatus comprising:

a kit separable from but connectable to the sewing machine, said kit comprising:

a housing detachably connectable to the sewing machine, said housing being separable from the sewing machine;

means for engaging the stitchable material when said kit is attached to the sewing maching and while the sewing needle is interfacing with the stitchable material, said means for engaging being interconnected with and movable relative to said housing; and means for moving said means for engaging in a timed relation with the sewing needle when said kit is attached to the sewing machine, said means for moving comprising a first bar interconnected with said housing, at least partially disposed within said housing, and movable relative to said housing, wherein the needle bar and said first bar are contained within different and separate structures when said kit is attached to the sewing machine.

2. An apparatus, as claimed in claim 1, wherein:

said housing includes a lower bore extending through a lower portion of said housing, said lower bore being vertically aligned with a longitudinal axis of at least a portion of said means for engaging.

3. An apparatus, as claimed in claim 2, wherein:

said at least a portion of said means for engaging is vertically reciprocable within said lower bore and relative to said housing and comprises said first bar.

4. An apparatus, as claimed in claim 1, wherein:

said means for engaging comprises a jump foot bar and a jump foot, said jump foot being fastened to said jump foot bar and capable of engaging portions of the stitchable material when said kit is attached to the sewing machine, wherein said first bar comprises said jump foot bar.

5. An apparatus, as claimed in claim 4, wherein:

said jump foot bar is interconnected with a portion of said means for moving which is in turn interconnected with the needle bar when said kit is attached to the sewing machine.

6. An apparatus, as claimed in claim 1, wherein:

said means for moving comprises a cam interfaceable with the needle bar when said kit is attached to the sewing machine, a first link pivotally connected to said housing and having a roller rotatably mounted thereon for rollably engaging said cam, and a second link interconnecting said first link and said means for engaging.

7. An apparatus, as claimed in claim 6, further comprising:

actuating means, interconnected with said means for engaging, for biasing said roller against said cam.

8. An apparatus, as claimed in claim 7, wherein:

said actuating means moves said roller between first and second positions, said first position corresponding to said roller being displaced from said cam, said second position corresponding to said roller being engaged with said cam.

9. An apparatus, as claimed in claim 7, wherein:

said actuating means comprises an air cylinder.

10. An apparatus, as claimed in claim 7, wherein:

said housing includes an upper bore extending through an upper portion of said housing, said upper bore being vertically aligned with a longitudinal axis of at least a portion of said means for engaging, wherein a portion of said means for engaging is vertically reciprocable within said upper bore and an upper portion of said means for engaging is interconnected with said actuating means.

11. An apparatus, as claimed in claim 1, further comprising:

means for detachably connecting said housing to the sewing machine, said means for detachably connecting being movable between at least two positions, said first position establishing a connection between said housing and the sewing machine and said second position providing for a disengagement between said housing and the sewing machine such that the housing may be totally removed from the sewing machine.

12. An apparatus, as claimed in claim 1, wherein:

said means for engaging comprises a jump foot bar interconnected with the needle bar when said kit is attached to the sewing machine and a jump foot associated with said jump foot bar, said jump foot bar and the needle bar being separated by a distance of at least about ¼ inch measured along a line parallel with the sewing machine head when said kit is attached to the sewing machine, wherein said first bar comprises said jump foot bar.

13. A jump foot kit assembly for a sewing machine, the sewing machine comprising a head, a sewing needle reciprocable relative to the head, a sewing needle drive assembly for driving the sewing needle and comprising a reciprocable needle bar, and a throat plate which supports a stitchable material and through which the sewing needle passes to interact with additional sewing components and contained at least in part within the head to provide stitching on the stitchable material, the sewing needle being attached to the needle bar, the needle bar being interconnected with the head, disposed at least partially within the head, and movable relative to the head, said jump foot kit assembly comprising:

a housing detachably connectable to the head of the sewing machine whereby said housing is separable from the head, said housing comprising a lower bore extending through a lower portion of said housing;

a reciprocable jump foot driver slidably disposed in said lower bore of said housing, wherein said jump foot driver is interconnected with said housing, at least partially disposed within said housing, and movable relative to said housing;

a jump foot attached to said jump foot driver and when said kit is attached to the sewing machine, said jump foot is engageable with the stitchable material timed relation with the sewing needle is engaged with the stitchable material while the sewing needle is interfacing with the stitchable material, wherein said jump foot driver is interconnectable with the needle bar of the sewing needle drive assembly when said kit is attached to the sewing machine to move said jump foot driver relative to said housing to engage said jump foot, associated with said jump foot driver, with the stitchable material in a timed relation with the reciprocating sewing needle when said kit is attached to said sewing machine, wherein the needle bar and said jump foot driver are thereby contained within different and separate structures when said kit is attached to the sewing machine.

14. A jump foot kit assembly, as claimed in claim 13, wherein:

said jump foot is interconnected with a lower end of said jump foot driver, said jump foot retaining the stitchable material against the throat plate in a timed relation with the sewing needle when said kit is attached to the sewing machine.

15. A jump foot kit assembly, as claimed in claim 13, wherein said jump foot kit assembly further comprises:

a means for interconnecting said jump foot driver with the needle bar to move said jump foot driver in a timed relation relative to the needle bar when said kit is attached to the sewing machine.

16. A jump foot kit assembly, as claimed in claim 13, further comprising:

means for detachably connecting said housing to the sewing machine, said means for detachably connecting being movable between at least two positions, said first position establishing a connection between said housing and the sewing machine and said second position providing for a disengagement between said housing and the sewing machine such that said housing may be totally removed from the sewing machine.

17. An apparatus attachable to a sewing machine for engaging stitchable material on which the sewing machine performs sewing operations, the sewing machine having a head and a sewing needle assembly comprising a sewing needle supported by a needle bar, the head containing components for driving the sewing needle assembly, said apparatus comprising:

a kit separable from but connectable to the sewing machine, said kit comprising:

a housing detachably connectable to the sewing machine;

means for engaging the stitchable material, said means for engaging being interconnected and movable relative to said housing; and means for moving said means for engaging in a timed relation with the sewing needle, wherein said means for moving comprises a cam interfaceable with the needle bar, a first link pivotally connected to said housing and having a roller rotatably mounted thereon for rollably engaging said cam, and a second link interconnecting said first link and said means for engaging.

18. An apparatus, as claimed in claim 17, further comprising:

actuating means, interconnected with said means for engaging, for biasing said roller against said cam.

19. An apparatus, as claimed in claim 18, wherein:

said actuating means moves said roller between first and second positions, said first position corresponding to said roller being displaced from said cam, said second position corresponding to said roller being engaged with said cam.

20. An apparatus, as claimed in claim 18, wherein:

said actuating means comprises an air cylinder.

21. An apparatus, as claimed in claim 18, wherein:

said housing includes an upper bore extending through an upper portion of said housing, said upper bore being vertically aligned with a longitudinal axis of at least a portion of said means for engaging wherein a portion of said means for engaging is vertically reciprocable within said upper bore and an upper portion of said means for engaging is interconnected with said actuating means.

* * * * *